US006607261B1

(12) United States Patent
Shimada

(10) Patent No.: US 6,607,261 B1
(45) Date of Patent: Aug. 19, 2003

(54) PRINTING APPARATUS WITH ADJUSTABLE DOT CREATION TIMINGS

(75) Inventor: Kazumichi Shimada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 09/620,591

(22) Filed: Jul. 20, 2000

Related U.S. Application Data

(63) Continuation of application No. PCT/JP99/06464, filed on Nov. 18, 1999.

(30) Foreign Application Priority Data

Nov. 20, 1998 (JP) ..... 10-347800

(51) Int. Cl.[7] ..... B41J 29/393
(52) U.S. Cl. ..... 347/19; 400/74
(58) Field of Search ..... 347/19, 40; 400/74

(56) References Cited

U.S. PATENT DOCUMENTS

| | | | | |
|---|---|---|---|---|
| 4,675,696 A | | 6/1987 | Suzuki | 347/19 |
| 5,250,956 A | * | 10/1993 | Haselby et al. | 347/19 |
| 5,350,929 A | | 9/1994 | Meyer et al. | 347/19 |
| 6,076,915 A | * | 6/2000 | Gast et al. | 347/19 |
| 6,164,749 A | * | 12/2000 | Williams | 347/19 |

FOREIGN PATENT DOCUMENTS

| | | |
|---|---|---|
| EP | 0 630 750 | 12/1994 |
| EP | 0 674 993 | 10/1995 |
| JP | 58-87064 | 5/1983 |
| JP | 60-217165 | 10/1985 |
| JP | 3-153358 | 7/1991 |
| JP | 4-151252 | 5/1992 |
| JP | 11-5343 | 1/1999 |

* cited by examiner

*Primary Examiner*—Lamson Nguyen
*Assistant Examiner*—Julian D. Huffman
(74) *Attorney, Agent, or Firm*—Oblon, Spivak, McClelland, Maier & Neustadt, P.C.

(57) ABSTRACT

In a printer that creates dots with a plurality of color inks K, C, M, and Y in both a forward pass and a backward pass of main scan, a delay circuit is provided corresponding to each nozzle array, in order to change an ink ejection timing. The technique of the present invention prints seven test patterns, so as to specify dot creation timings with regard to the K ink in the backward pass, the C ink in both the forward pass and the backward pass, the M ink in both the forward pass and the backward pass, and the Y ink in both the forward pass and the backward pass relative to the dot creation timing with regard to the K ink in the forward pass set as a standard. The delay circuit delays an output timing of a driving waveform to a print head according to the specified dot creation timing. This arrangement effectively prevents a misalignment of dot recording positions with regard to all the color inks in both the forward pass and the backward pass of the main scan, thereby attaining high-quality printing. The delay circuit may be provided corresponding to each ink color or each nozzle group, for example, having a common nozzle driving mechanism, other than each nozzle array. The technique of the present invention is also applicable to adjust the dot creation timing with regard to each nozzle group in a printer that creates dots only in either the forward pass or the backward pass of the main scan.

58 Claims, 16 Drawing Sheets

Fig. 1 2
| | K | C | M | Y |
|---|---|---|---|---|
| Forward Pass | Standard | 2 | 3 | 4 |
| Backward Pass | 4 | 5 | 4 | 2 |
Fig. 13(a)
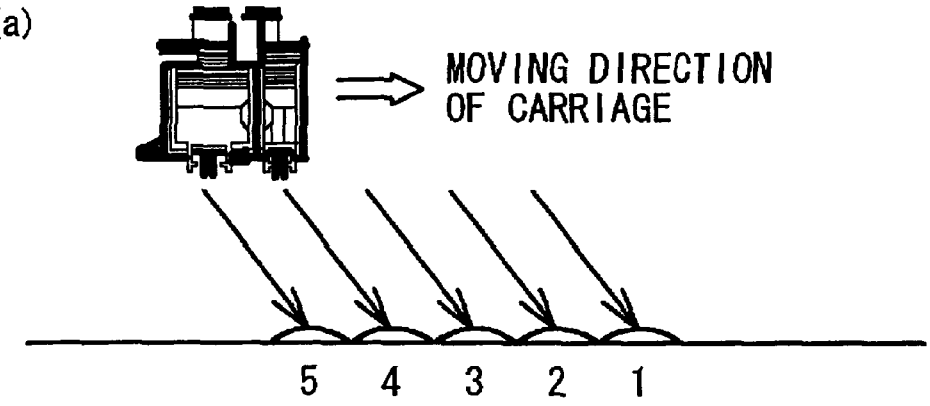
Fig. 13(b)
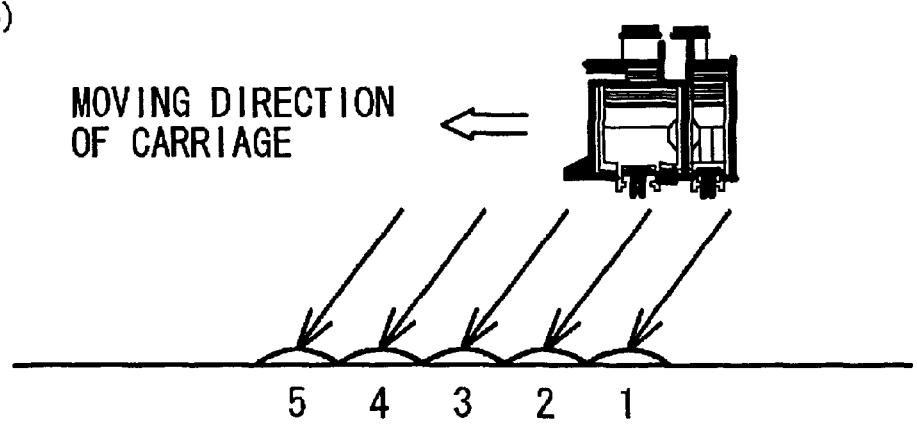

Fig. 1 4
| | Standard | Objects of Adjustment | | | | | | |
|---|---|---|---|---|---|---|---|---|
| Embodiment | K-F | K-F | C-F | C-B | M-F | M-B | Y-F | Y-B |
| Modification 1 | K-F | K-B | C-F | C-B | M-F | M-B | | |
| Modification 2 | K-F | K-B | | | | | | |
| | C-F | C-B | | | | | | |
| | M-F | M-B | | | | | | |
| | Y-F | Y-B | | | | | | |
| Modification 3 | K-F | K-B | C-F | M-F | Y-F | | | |
Fig. 15(a)
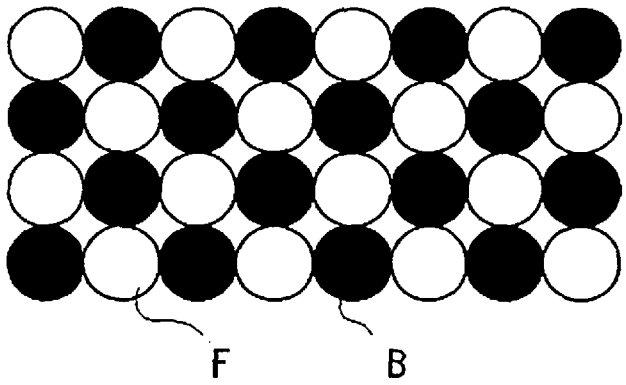
Fig. 15(b)
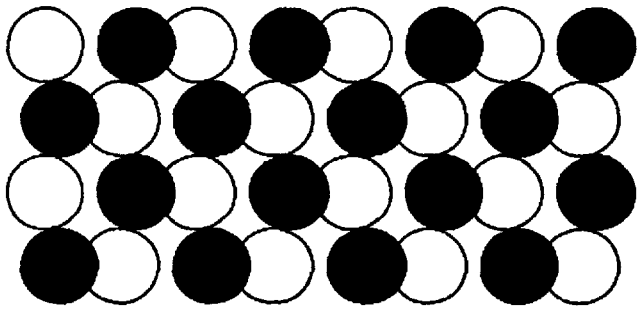

PRINTING APPARATUS WITH ADJUSTABLE DOT CREATION TIMINGS

CROSS-REFERENCE TO RELATED APPLICATIONS

This application is a continuation application based on PCT application Serial. No. PCT/JP99/06464 filed on Nov. 18, 1999, the entire contents of which are incorporated by reference. This application also claims priority to Japanese Patent Application No. 10-347800, filed on Nov. 20, 1998, the entire contents of which are incorporated by reference.

BACKGROUND OF THE INVENTION

1. Field of the Invention

The present invention relates to a printing apparatus that creates dots on a printing medium during a main scan and thereby prints an image. More specifically, the present invention pertains to a printing apparatus that is capable of adjusting the dot creation timings during the main scan.

2. Discussion of the Background

An ink jet printer is one of the printing apparatuses that perform a main scan and sub-scan of a print head and prints a multi-color image. The ink jet printer ejects inks of multiple colors, for example, cyan, magenta, yellow, and black to create dots. Creation of dots with the multiple color inks at various recording ratios results in printing a multi-color image. To attain the high quality printing by the ink jet printer, it is desirable that there is no relative misalignment of the positions of dots created with the respective color inks. For the purpose of preventing such misalignment, the timings of dot creation with the respective color inks are adjusted at the time the ink jet printer is shipped.

Some of the ink jet printers create dots in both a forward pass and a backward pass in a main scanning direction to enhance the recording speed (such recording technique is hereinafter referred to as the bidirectional recording). To print an image of favorable quality, it is necessary to make the dots formed in the forward pass align with the dots formed in the backward pass in the main scanning direction.

FIGS. 15(*a*) and 15(*b*) show states of dots created by the bidirectional recording technique. Open circles represent dots formed in the forward pass of the main scan, whereas closed circles represent dots formed in the backward pass of the main scan. FIG. 15(*a*) shows a state, in which the dots formed in the forward pass align with the dots formed in the backward pass in the main scanning direction, FIG. 15(*b*) shows another state, in which the dots formed in the backward pass are shifted rightwards relative to the dots formed in the forward pass. The relative misalignment of the dots formed in the forward pass with the dots formed in the backward pass causes an unevenness of density and thereby lowers the picture quality of the resulting printed image.

The misalignment of the positions of dot creation in the forward pass and in the backward pass is caused by a diversity of factors, such as plays (backlashes) required in the driving mechanism of the printer. The misalignment is also due to a variation in thickness of the printing medium or printing paper.

FIGS. 21(*a*) and 21(*b*) show misalignment of the positions of dot creation in the forward pass and in the backward pass according to the thickness of printing paper. In the example of FIG. 21(*a*), a dot dt11 is formed on a sheet of printing paper PA1 in the forward pass, and a dot dt12 is formed adjacent to the dot dt11 in the backward pass. A nozzle Nz ejects ink droplets Ik11 and Ik12 at respective positions shown in FIG. 21(*a*), which are determined by taking into account the speed of the forward pass and the backward pass. The ink droplets Ik11 and Ik12 respectively draw loci shown in FIG. 21(*a*) and hit target positions to form the dots dt11 and dt12.

FIG. 21(*b*) shows a state with a sheet of thicker printing paper PA2. In this case, the distance between the nozzle Nz and the printing paper PA2 is less than the distance between the nozzle Nz and the printing paper PA1 in the example of FIG. 21(*a*). Ejection of ink droplets in the forward pass and in the backward pass at the same timings as those in the case of FIG. 21(*a*) causes ink droplets Ik21 and Ik22 to respectively draw loci shown in FIG. 21(*b*) and hit against the printing paper thereby forming dots dt21 and dt22. Accordingly, there is an undesirable gap between the dots thus created, and the resulting recorded image is different from a target image to be recorded. In order to obtain the target image to be recorded, the timing of dot creation in the backward pass should be set later than the timing shown in FIG. 21(*b*).

The conventionally adopted technique adjusts the dot creation timing using a test pattern so as to prevent the misalignment due to the diversity of factors. The technique records a predetermined test pattern while varying the dot creation timing in the forward pass and in the backward pass. The dot creation timing is then adjusted to the timing that gives the favorable results of recording. By taking into account the diversity of factors discussed above, the adjustment of the dot creation timing should be performed not only when the printer is shipped but also in occasions required by the user.

The prior art technique actually performs the adjustment of the dot creation timing only for one color, that is, the black ink, and collectively modifies the dot creation timings of the other colors based on the results of the adjustment.

The adjustment of the dot creation timing is not performed sufficiently in conventional printers. The insufficient adjustment causes the originally low picture quality of the resulting printed image in some printers and lowers the picture quality with an elapse of time in other printers. In the printer of the bidirectional recording, the dot creation timing is adjusted according to a test pattern. Such adjustment may, however, not sufficiently improve the picture quality of the resulting printed image. The deteriorating picture quality is partly due to a misalignment of dot recording positions between different colors.

The deteriorating picture quality due to the misalignment of dots is found not only in the case of bidirectional printing but in the case of performing printing operations only in a single direction of the main scan (hereinafter referred to as the unidirectional recording). The print head in a printer typically has a large number of nozzles that are arrayed in both the main scanning direction and the sub-scanning direction to have a two-directional arrangement. Unless the dot creation timing is adequately adjusted between nozzles having different positions in the main scanning direction, there is a misalignment of dots in the main scanning direction in the case of unidirectional printing. In the printer having a plurality of different color inks, there is a variation in ink ejection speed due to the difference in characteristics of the respective inks. This also leads to a misalignment of dot recording positions. A variation in ink ejection properties due to the difference in driving mechanism of nozzles also results in a misalignment of dot recording positions. Such misalignment lowers the picture quality of the resulting printed image.

The recent trend requires the printer to record fine dots and enable printing with a high resolution. In the case of printing with a high resolution, however, only a slight misalignment of dots may correspond to a misalignment of dot recording positions by the unit of pixels. In the printer that performs printing with a high resolution to improve the picture quality, the deteriorating picture quality due to such misalignment is not negligible. Not only the misalignment of dot recording positions between different colors, but any misalignment of dots is not of course negligible for the improvement in picture quality.

SUMMARY OF THE INVENTION

Accordingly, an object of the present invention is to solve the problems discussed above and to prevent a positional misalignment of dots and attain high-quality printing in a printing apparatus that performs a main scan of a print head to print a multi-color image.

To achieve these and other objects, the present invention provides a printing apparatus that performs a main scan and causes a print head having nozzles for ejecting ink to create dots on surface of a printing medium at a predetermined dot creation timing during the main scan. The main scan moves the print head forward and backward relative to the printing medium. The print head has a plurality of nozzle groups, each nozzle group including a plurality of nozzles having a predetermined common condition relating to ink ejection. The printing apparatus includes a timing specification unit that inputs an instruction to change the dot creation timing in the course of the main scan with regard to each of at least two nozzle groups selected among the plurality of nozzle groups, an adjustment unit that adjusts the dot creation timing with regard to the each nozzle group, based on the input, and a drive control unit that drives each nozzle group at the adjusted dot creation timing in the course of the main scan so as to create dots.

A variety of settings may be applicable to specify the nozzle groups according to the structure of the printing apparatus.

In accordance with a first setting, in the case where the print head is capable of ejecting inks of multiple colors, each of the plurality of nozzle groups includes a plurality of nozzles that eject an identical color ink.

It is not necessary to change the dot creation timing individually with regard to all the nozzle groups provided on the print head. For example, in the first setting, the at least two nozzle groups, which are objects of the changing instruction, may correspond to specific colors that are selected out of the multiple colors and other than a predetermined color having little effects on picture quality.

In accordance with a second setting, each of the plurality of nozzle groups includes a plurality of nozzles having an identical position in a main scanning direction.

In accordance with a third setting, in the case where the print head has a sufficient number of driving units (each driving unit having a plurality of driving elements for driving the nozzles so as to enable one driving element to be mapped to one nozzle), each of the plurality of nozzle groups includes a plurality of nozzles that are driven by an identical driving unit.

In accordance with a fourth setting, in the case where the print head ejects a plurality of different inks having different properties relating to ink ejection, each of the plurality of nozzle groups includes a plurality of nozzles that eject ink having a practically identical property. The property relating to ink ejection is, for example, viscosity, specific gravity, or surface tension of ink.

In the fourth setting, when the print head ejects a plurality of different inks having different densities, each of the plurality of nozzle groups includes a plurality of nozzles that eject ink of an equivalent density. For example, in the case where the print head has both a higher density ink and a lower density ink for cyan and magenta, nozzles corresponding to the cyan and magenta inks of the higher density are included in one nozzle group, whereas nozzles corresponding to the cyan and magenta inks of the lower density are included in another nozzle group. Such setting is applicable to the print head that provides inks of three or more different densities for a plurality of colors. In this case, nozzles corresponding to the respective colors of an equivalent density are included in an identical nozzle group.

In the printing apparatus of the present invention, the instruction of changing the dot creation timing is input for each nozzle group so as to adjust the dot creation timing. The technique of the present invention enables the dot recording positions of the respective nozzle groups to be more adequately aligned than the prior art technique. This arrangement effectively reduces the misalignment of dots created by different nozzle groups corresponding to, for example, different colors, thereby attaining the high-quality printing.

In conventional printing apparatus, the misalignment of dots between different nozzle groups may be found even at the time of shipment. Such misalignment is caused by the varying speed of ink election from the respective nozzle groups, which is ascribed to the respective nozzle groups on the print head having different ink ejection properties or the respective color inks having different properties.

The inventors of the present invention have found that the misalignment of dots occurring in the conventional printing apparatus is caused by a variety of factors arising after the shipment of the printing apparatus as discussed below in addition to the above factors. The ink ejection speed is generally affected by the viscosity of ink. It is practically impossible to make all the inks in any replaceable ink cartridges have a strictly identical viscosity. Namely, there is a variation in ink ejection speed among the respective inks. The viscosity of ink also varies with an elapse of service time and with a variation in temperature. The mechanism of ejecting ink is also subject to deterioration with age. In the conventional printing apparatus there is a misalignment of dot recording positions, due to a variation in ink ejection speed by the variety of factors arising after the shipment as well as those found even before the shipment.

The inventors of the present invention have developed the printing apparatus discussed above, based on the idea that the accurate adjustment of the dot creation timing of each nozzle group, not only during the manufacturing process of the printing apparatus but during its use, is the best way to cancel the misalignment due to the diversity of factors. The arrangement of the present invention enables the dot creation timing of each nozzle group to be accurately regulated in the manufacturing process of the printing apparatus. This arrangement also enables the user to adequately adjust the dot creation timing of each nozzle group after shipment. Even when a misalignment of the dot recording positions occurs after shipment due to any of the factors discussed above, the user can readily make the adequate adjustment, and thereby maintain the high picture quality of the resulting printed image.

One applicable method individually adjusts the dot creation timing with regard to each of the plurality of nozzle groups. Another applicable method fixes the dot creation timing with regard to a specific nozzle group and adjusts the dot creation timing with regard to another nozzle group relative to the fixed dot creation timing of the specific nozzle group.

As described previously, it is not necessary to regulate the dot creation timing for all the nozzle groups mounted on the print head. The nozzle groups having relatively small effects on the picture quality of the resulting printed image may be excluded from the objects of regulation of the dot creation timing.

This arrangement effectively reduces the misalignment of the dot recording position with regard to the nozzle groups having the significant effects on the picture quality of the resulting printed image, while excluding the individual adjustment of the dot creation timing with regard to the nozzle groups having relatively small effects on the picture quality. The technique thus ensures the significant improvement in picture quality of the resulting printed image, while reducing the labor required for the adjustment. The adjusted dot creation timing for any nozzle group or a preset fixed dot creation timing may be set to the dot creation timing with regard to each nozzle group having relatively small effects on the picture quality.

In the case of defining the nozzle groups by the colors, the nozzle groups having relatively small effects on the picture quality correspond to the colors of low visual conspicuousness and the colors of low density. In the printing apparatus with cyan, magenta, yellow and black inks, yellow is the color having the small effect on the picture quality. In the printing apparatus with inks of different densities, for example, cyan, light cyan, magenta, light magenta, yellow and black inks, the three colors (i.e., yellow, light cyan, and light magenta) are the colors having the small effect on the picture quality. In any case, such colors are adequately selected by considering the actual effects of the misaligned dots on the picture quality. The nozzle group having the small effect on the picture quality is not necessarily the nozzle group corresponding to the color of low density. In some images, the nozzle group having the small effect on the picture quality is the nozzle group used for dot creation with low frequency.

In the printing apparatus of the present invention, the adjustment of the dot creation timing may include software. However, it is preferable that the adjustment unit has a delay circuit corresponding to each of the plurality of nozzle groups. Here the delay circuit functions to adjust an output timing of a driving signal of the print head in response to the changing instruction.

The delay circuit may delay the output timing of the driving signal to the print head according to the number of pulses input into a counter circuit. A plurality of circuits having different output timings of the driving signal may be selectively used in response to the changing instruction. A variety of other structures may be applied for the delay circuit. The use of such circuits having relatively simple structures enables the accurate adjustment of the dot creation timing.

As mentioned previously, the misalignment of dot recording positions also occurs in the case of unidirectional recording. The technique of the present invention is thus applied to the printing apparatus of unidirectional recording that records dots only in either the forward pass or the backward pass of the main scan to improve the picture quality of the resulting printed image. The technique of the present invention is more preferably applied to the printing apparatus that drives the print head in both the forward pass and the backward pass of the main scan (i.e., the printing apparatus that performs the bidirectional recording).

Application of the technique of the present invention to the printing apparatus of bidirectional recording ensures the high-speed and high-quality printing of images. In the case of bidirectional printing, there is a fair possibility that the misalignment, which generally leads to the low picture quality, occurs not only between the dots created by the different nozzle groups but between the dots created in the forward pass and in the backward pass. The technique of the present invention is thus favorably applied to the printing apparatus of bidirectional recording to prevent such misalignment of dots and significantly improve the picture quality of the resulting printed image.

In the printing apparatus of bidirectional printing, the adjustment unit may be used to adjust the dot creation timing between the plurality of nozzle groups. The adjustment unit is, however, more preferably used to adjust the dot creation timing with regard to each nozzle group in each direction of the main scan. Namely, it is preferable the adjustment unit individually adjusts the dot creation timings in the forward pass and the backward pass of the main scan with regard to each nozzle group. This arrangement enables the dot recording positions to be aligned with a higher accuracy.

In accordance with one preferable application of the present invention, the printing apparatus of unidirectional recording includes a test pattern printing unit that prints a predetermined test pattern with each of the at least two nozzle groups that are objects of the changing instruction. The predetermined test pattern is set to allow detection of a relative misalignment of dots created in either the forward pass or the backward pass of the main scan.

In a similar manner, it is preferable that the printing apparatus of bidirectional recording includes a test pattern printing unit that prints a predetermined test pattern with each of the at least two nozzle groups that are objects of the changing instruction. The predetermined test pattern is set to allow detection of a relative misalignment of dots created in the forward pass of the main scan with dots created in the backward pass of the main scan.

There is a misalignment of dots created in the forward pass with dots created in the backward pass by each nozzle group. There is another misalignment of dots between different nozzle groups. The printing apparatus of the above application detects any combination of such misalignments of dot recording positions. This accordingly enables the accurate adjustment of the dot recording positions and thereby improves the picture quality of the resulting printed image.

It is not necessary the test pattern printing unit uses only one test pattern to detect all the misalignments of dot recording positions in the forward pass and the backward pass with regard to the respective colors. One applicable method successively prints a plurality of test patterns to detect such misalignments. It is also not necessary to detect all the misalignments in the forward pass and the backward pass with regard to the respective nozzle groups.

In addition, the test pattern printing unit may print the test pattern in any of various applications discussed below.

In accordance with a first preferable application of the printing apparatus, the test pattern printing unit includes a specific group test pattern printing unit that prints a first test pattern with one specific nozzle group, which is selected among the at least two nozzle groups that are the objects of the changing instruction. The first test pattern includes both dots created in the forward pass of the main scan and dots created in the backward pass of the main scan at a preset positional relationship. Also included is another group test pattern printing unit that prints a second test pattern. The second test pattern includes both dots created by another nozzle group other than the specific nozzle group and dots created by the specific nozzle group, to allow detection of a relative misalignment of dot recording positions of the another nozzle group and the specific nozzle group in at least one of the forward pass and the backward pass of the main scan.

This arrangement enables the dot creation timing to be adjusted with regard to the specific nozzle group to reduce the misalignment of dots created in the forward pass with dots created in the backward pass. The dot creation timing with regard to another nozzle group is adjusted relative to the dot creation timing of the specific nozzle group to reduce the misalignment of dots created in either the forward pass or the backward pass of the main scan. The dot creation timings in the forward pass and the backward pass of the main scan are adjusted with regard to each of the other nozzle groups by taking advantage of the adjusted dot creation timings in the forward pass and the backward pass with regard to the specific nozzle group. The test pattern printing unit of this arrangement enables the positions of dots created in the forward pass and the backward pass to be aligned with regard to the plurality of nozzle groups.

In accordance with a second preferable application of the printing apparatus, the test pattern printing unit prints a certain test pattern with each of the at least two nozzle groups that are the objects of the changing instruction. The certain test pattern includes both dots created in the forward pass of the main scan and dots created in the backward pass of the main scan at a predetermined positional relationship.

This arrangement enables the positions of dots created in the forward pass of the main scan to be aligned with dots created in the backward pass of the main scan with regard to each nozzle group. This technique is preferably adopted to adjust the dot creation timing, in the case where there is a more significant misalignment between dots created in the forward pass and in the backward pass than a misalignment between dots created by different nozzle groups. The technique thereby readily improves the picture quality of the resulting printed image.

In accordance with a third preferable application of the printing apparatus, the test pattern printing unit prints a specific test pattern with a certain nozzle group corresponding to a specific color of low visual conspicuousness, among the at least two nozzle groups that are the objects of the changing instruction. The specific test pattern includes both dots created by the certain nozzle group and dots created by another nozzle group, which has an adjusted dot creation timing, to enhance visual conspicuousness of the relative misalignment.

This arrangement ensures the accurate adjustment of the dot creation timing with regard to the dots of low visual conspicuousness. For example, it is assumed that yellow dots are printed on white printing paper. Since the yellow dots have low visual conspicuousness, it is difficult to adjust the dot recording positions with high accuracy. In such cases, the yellow dots are formed with the cyan dots having the adjusted dot creation timing in an overlapping manner to be expressed as green dots. This technique enhances the visual conspicuousness and ensures the more accurate adjustment of the dot creation timing. Dots of different colors may be mixed in a variety of patterns.

In the printing apparatus having the test pattern printing unit, it is desirable that the timing specification unit specifies the dot creation timing based on a relation to the printed test pattern.

This arrangement facilitates the specification of the dot creation timing. One procedure allocates preset indexes to respective dot creation timings, at which the test pattern is printed, and specifies the adequate dot creation timing by the index. Another procedure repeats the cycle of printing the test pattern at a selected dot creation timing and determines whether or not the selected dot creation timing is adequate, thereby specifying the appropriate dot creation timing.

In accordance with another preferable application of the printing apparatus, the adjustment unit may define the dot creation timing of a specific nozzle group as a standard and advance or delay the dot creation timing of another nozzle group relative to the standard. In this case, to allow printing at an earlier dot creation timing than the standard dot creation timing, it is desirable to set the standard to a specific dot creation timing for creating dots with delay of a predetermined time period since the input of a signal indicating dot creation to the print head. This arrangement enables printing at an earlier dot creation timing than the standard dot creation timing in the range of the predetermined delayed time period.

In another embodiment, the adjustment unit may define a specific nozzle group having an earliest dot creation timing, among the at least two nozzle groups that are the objects of the changing instruction, as a standard and adjusts the dot creation timing of another nozzle group relative to the standard.

This arrangement enables the adjusted dot creation timing of each nozzle group to have certain delay relative to the standard dot creation timing. This arrangement is free from the undesirable restriction as in the case of fixing a specific color to the standard, but enables the dot creation timing to be adjusted in a wider range.

The technique of the present invention is also actualized in the form of a recording medium, in which a specific program is recorded as discussed below.

The present invention is accordingly directed to a first recording medium in which a specific program is recorded in a computer readable manner. The specific program functions to adjust a dot creation timing with regard to each of a plurality of nozzle groups in a printing apparatus that performs a main scan and causes a print head having nozzles for ejecting ink to create dots on surface of a printing medium at a predetermined dot creation timing in the course of the main scan. Each of the nozzle groups includes a plurality of nozzles having a predetermined common condition relating to ink ejection and the main scan moves the print head forward and backward relative to the printing medium. The specific program causes a computer to attain functions of printing a predetermined test pattern with each of at least two nozzle groups selected among the plurality of nozzle groups (the predetermined test pattern being set to allow detection of a relative misalignment of dots created in the forward pass of the main scan with dots created in the backward pass of the main scan), inputting a specified dot creation timing with regard to each of the nozzle groups, based on a relation to the printed test pattern, and changing a parameter, which specifies the dot creation timing, with regard to the each nozzle group based on the specified dot creation timing.

The present invention is also directed to a second recording medium in which a specific program for driving the printing apparatus of the present invention is recorded in a computer readable manner. The specific program causes a computer to attain a function of adjusting the dot creation timing with regard to each color in response to the changing instruction.

The computer executes the program recorded in either one of these recording media, so as to perform the adjustment of dot creation with regard to a plurality of nozzle groups. Typical examples of the recording medium include flexible disks, CD-ROMS, magneto-optic discs, IC cards, ROM cartridges, punched cards, prints with barcodes or other codes printed thereon, internal storage devices (memories like a RAM and a ROM) and external storage devices of the computer, and a variety of other computer readable media. The present invention is also directed to the program itself or a diversity of equivalent signals.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 10 shows a test pattern for black ink;

FIG. 11 shows a test pattern for color inks;

FIG. 12 shows an exemplified timing table;

FIGS. 13(*a*) and 13(*b*) show the relationship between the moving direction of a carriage and the variation in dot creation timing;

FIG. 14 shows applicable processes to adjust the dot creation timing;

FIGS. 15(*a*) and 15(*b*) show a first modified example of the test pattern;

FIG. 17 shows a third modified example of the test pattern;

FIG. 18 shows another print head as a first modified example;

FIG. 19 shows still another print head as a second modified example;

FIG. 20 shows another print head as a third modified example; and

DESCRIPTION OF THE PREFERRED EMBODIMENTS

Figure 1:
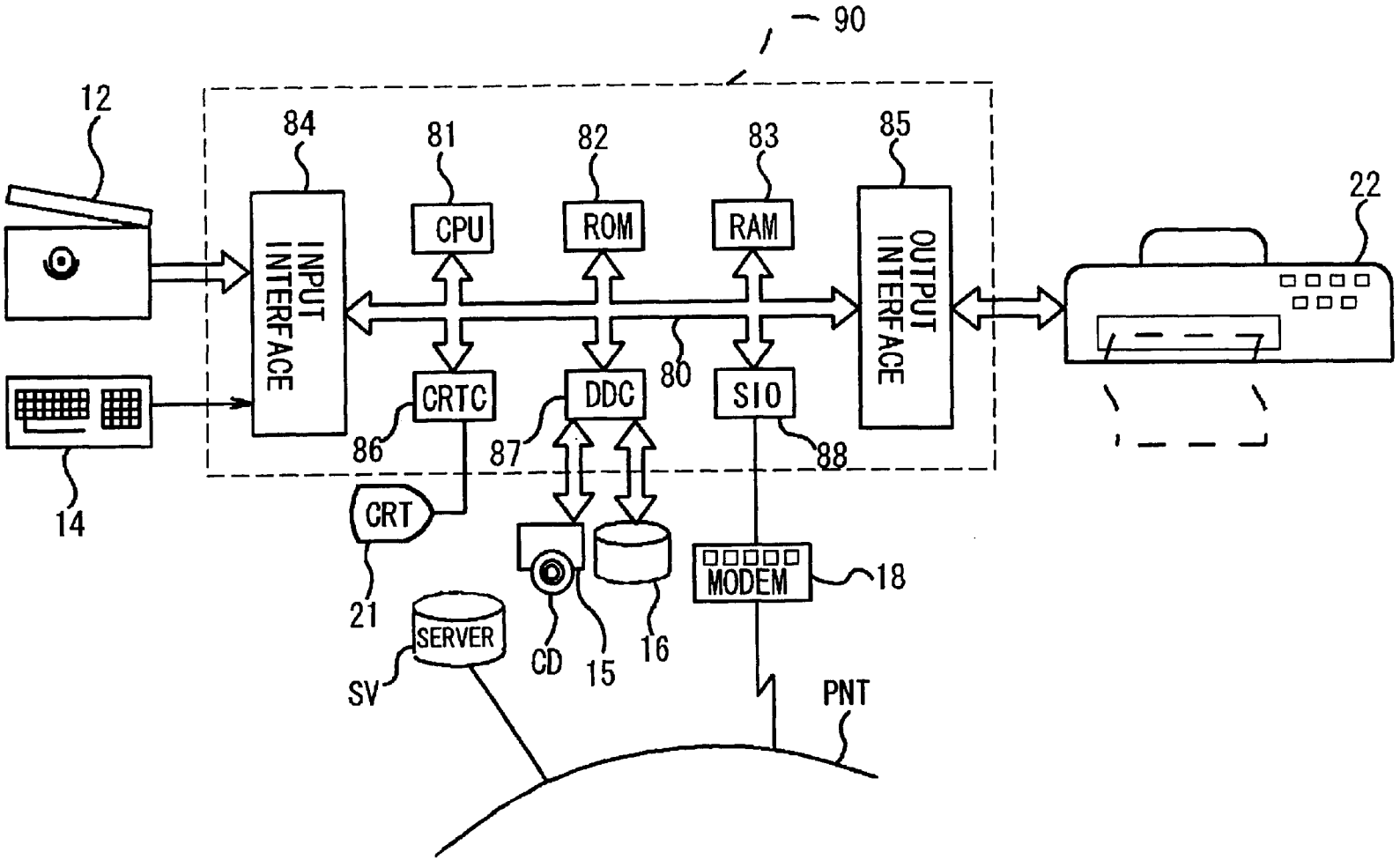
FIG. 1 schematically illustrates the structure of a printing system including a printing apparatus in one embodiment according to the present invention.

Various other objects, features and attendant advantages of the present invention will be more fully appreciated as the same becomes better understood from the following detailed description when considered in connection with the accompanying drawings in which like reference characters designate like or corresponding parts throughout the several views.

One embodiment of the present invention regards a color printer that ejects multiple color inks in both forward and backward passes of a main scan so as to print an image. In this embodiment, a nozzle group is provided with regard to each color ink. The technique of adjusting the positions of dot creation is described in the following order:

A. Structure of Apparatus

B. Dot Creation Routine

C. Adjustment of Dot Creation Timings

D. Modifications

A. Structure of Apparatus

FIG. 1 is a block diagram illustrating the structure of a printing system including a printing apparatus in one embodiment according to the present invention. The printing system includes a computer 90 connected to a scanner 12 and a color printer 22. The computer 90 reads and executes predetermined programs to function in combination with the color printer 22 as the printing apparatus. The computer 90 includes a CPU 81 that controls printing-related operations according to programs, a ROM 82, a RAM 83, and a diversity of elements mentioned below, which are mutually connected via a bus 80. An input interface 84 is in charge of input of signals from the scanner 12 and a keyboard 14. An output interface 8 is in charge of output of data to the printer 22. A CRTC 86 controls an output of signals to a color display CRT 21, and a disk controller (DDC) 87 controls transmission of data to and from a hard disk 16, a CD-ROM drive 1, and a non-illustrated flexible disk drive. A diversity of programs loaded into the RAM 83 for execution, a variety of programs provided in the form of device drivers, and test pattern data printed for the purpose of adjusting the timings of dot recording in the printer 22 are stored in the hard disk 16.

A serial input-output interface (SIO) 88 is also linked with the bus 80. The SIO 88 is connected to a modem 18 and further to a public telephone network PNT via the modem 18. The computer 90 is then connected to an external network via the SIO 88 and the modem 18. Such connection enables the computer 90 to gain access to a specific server SV and download a program required for printing images into the hard disk 16. The computer 90 may execute a required program loaded from a flexible disk FD or a CD-ROM, etc. The whole program required for the printing operations may be loaded collectively or only part of the program, which is characteristic of this embodiment, may be loaded in the form of a module.

Figure 2:
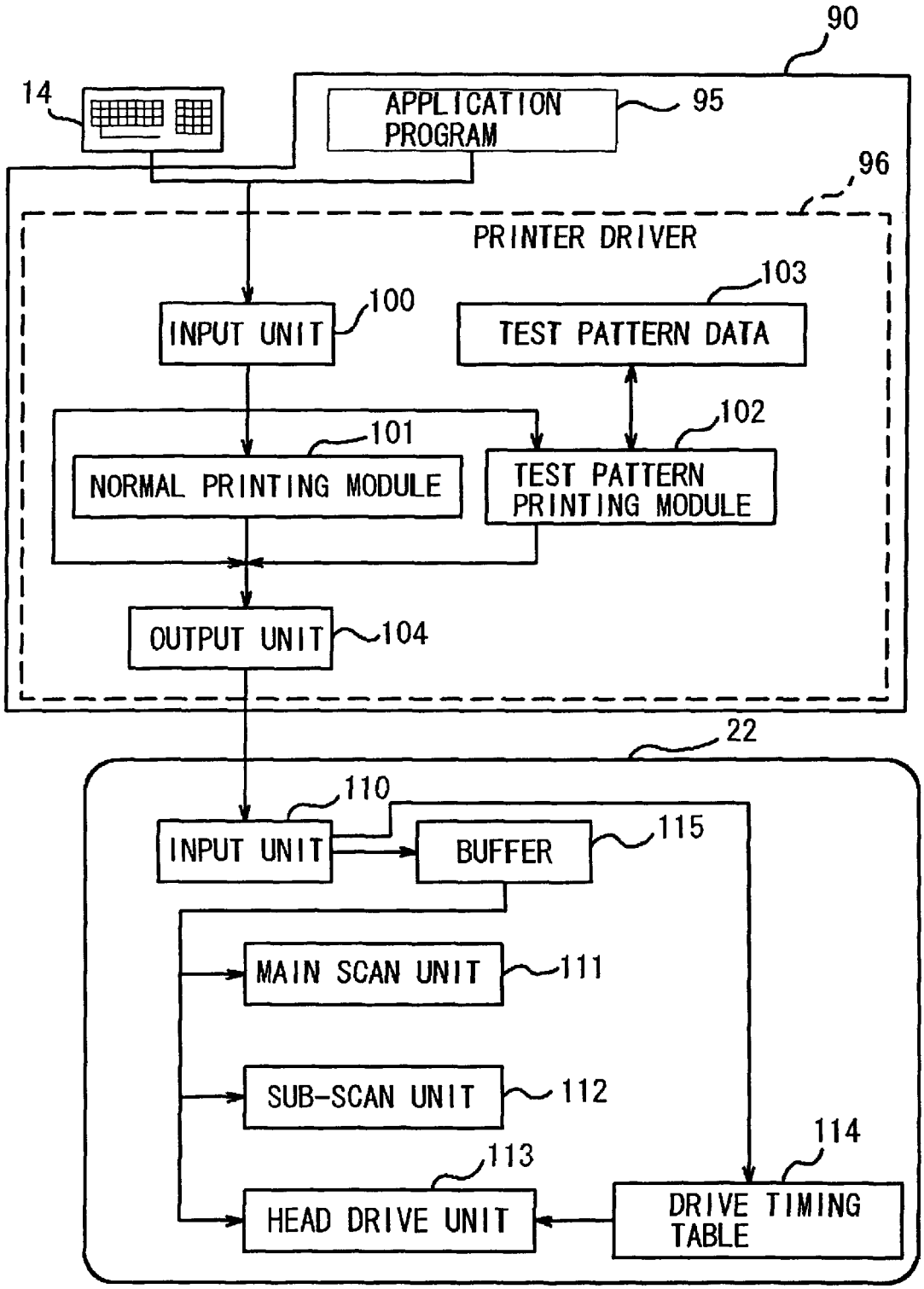
FIG. 2 shows the software configuration of the printing apparatus of the embodiment.

FIG. 2 is a block diagram showing the software configuration of the printing apparatus. In the computer 90, an application program 9 operates under the control of a predetermined operating system. A printer driver 96 is incorporated in the operating system. The application program 95 reads an image via the scanner 12 and performs the required processing, such as a retouch of the image.

The printer driver 96 receives a command from the keyboard 14 or a printing instruction from the application program 9 via an input unit 100. The printer driver 96 then executes an adequate series of the processing discussed below according to the input. In response to a printing instruction input from the application program 9, the printer driver 96 receives image data from the application program 9 and causes a normal printing module 101 incorporated therein to convert the image data into signals processible by the printer 22. The normal printing module 101 performs color correction that converts the color components of the input image data into color components corresponding to the inks used in the printer 22, halftone processing that causes the tone values of the input image data to be expressed by the dispersibility of dots, and rasterization that rearranges the color-corrected and halftone-processed data in a sequence of transfer to the printer 22. The resulting processed data are transferred via an output unit 104 to the printer 22.

One of the processes executed by the printer driver 96 in response to a command input from the keyboard 14 is adjustment of the dot creation timing in the printer 22. When an instruction is given to adjust the timing of dot creation, a test pattern printing module 102 included in the printer driver 96 drives the printer 22 to print a test pattern according to a stored test pattern data 103. The data used for printing the test pattern are output via the output unit 104 to the printer 22.

In the printer 22, an input unit 110 receives the image data or the test pattern data transferred from the printer driver 96 and stores the input data temporarily into a buffer 115. According to the data stored in the buffer 115, while a main scan unit 111 performs a main scan of a print head and a sub-scan unit 112 feeds printing paper, a head drive unit 113 drives the print head to print an image. The printer 22 creates dots in both a forward pass and a backward pass of the main scan. The timings of driving the print head are registered in a drive timing table 114.

In the process of adjusting the timing of dot creation, the user specifies an optimum print timing through the operation of the keyboard 14, based on the results of printing the test pattern. The printer driver 96 receives the specified print timing via the input unit 110 and outputs the specified print timing via the output unit 104 to the printer 22. The input unit 110 of the printer 22 receives the data regarding the specified print timing and rewrites the contents of the drive timing table 114 to change the timing of dot creation. The software configuration discussed above enables the printing apparatus of this embodiment to print an image while adjusting the timing of dot creation.

Figure 3:
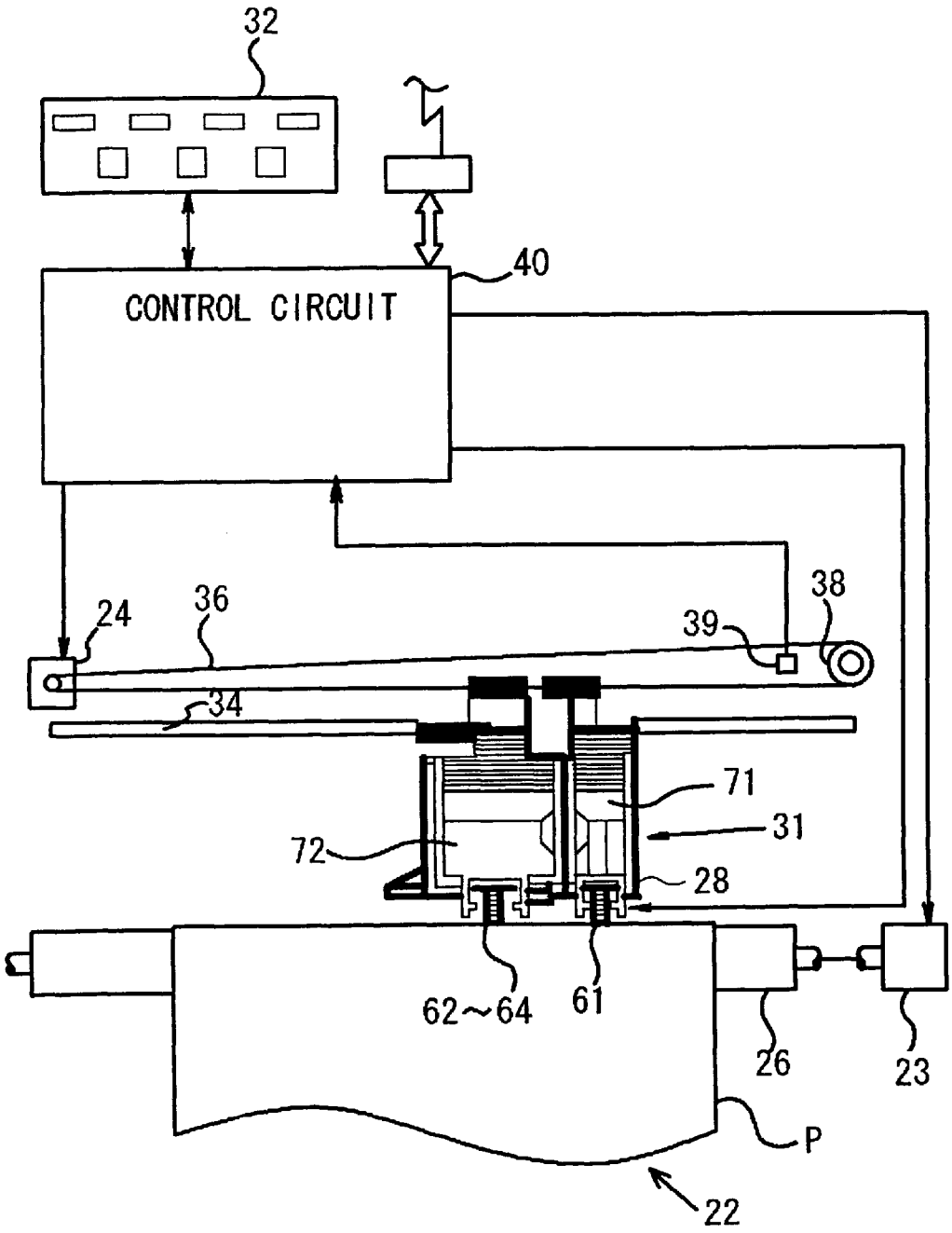
FIG. 3 schematically illustrates the structure of a printer shown in FIG. 1.

The schematic structure of the printer 22 is described with reference to FIG. 3. The printer 22 has a circuit for driving a sheet feed motor 23 to feed a sheet of printing paper P, a circuit for driving a carriage motor 24 to move a carriage 31 forward and backward along an axis of a platen 26, a circuit for driving a print head 28 mounted on the carriage 31 to implement ink ejection and dot creation, and a control circuit 40 that controls transmission of signals to and from the sheet feed motor 23, the carriage motor 24, the print head 28, and a control panel 32.

The circuit of reciprocating the carriage 31 along the axis of the platen 26 includes a sliding shaft 34 disposed in parallel with the axis of the platen 26 for slidably supporting the carriage 31, a pulley 38, an endless drive belt 36 spanned between the carriage motor 24 and the pulley 38, and a position sensor 39 that detects the position of the origin of the carriage 31.

A black ink cartridge 71 for black ink (K) and a color ink cartridge 72, in which three color inks, that is, cyan (C), magenta (M), and yellow (Y) are accommodated, are detachably attached to the carriage 31 in the printer 22. A total of four ink ejection heads 61 through 64 are formed on the print head 28 disposed in the lower portion of the carriage 31. Ink conduits 68 are formed in the bottom of the carriage 31 to lead supplies of inks from ink reservoirs to the respective ink ejection heads.

Figure 4:
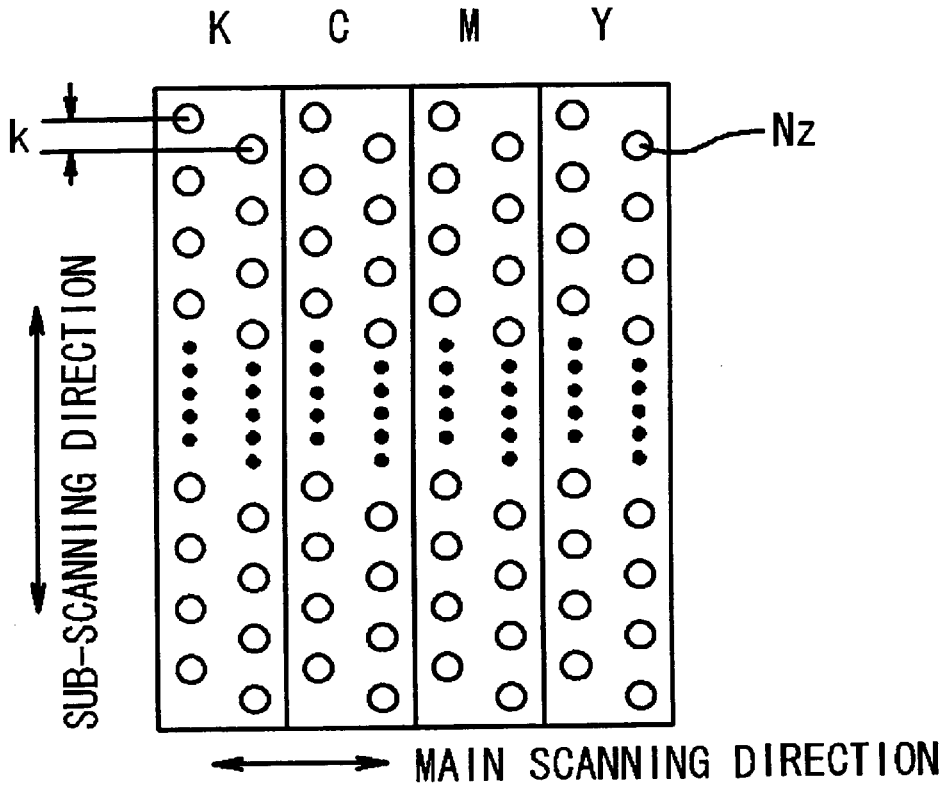
FIG. 4 shows an arrangement of nozzles on a print head.

FIG. 4 shows an arrangement of nozzles in the respective ink ejection heads 61 through 64. The arrangement of nozzles shown in FIG. 4 includes four nozzle arrays, in which each nozzle array ejects ink of each color and includes forty-eight nozzles Nz arranged in zigzag at a fixed nozzle pitch k. The positions of the corresponding nozzles in the respective nozzle arrays are coincident with one another in a sub-scanning direction.

Figure 5:
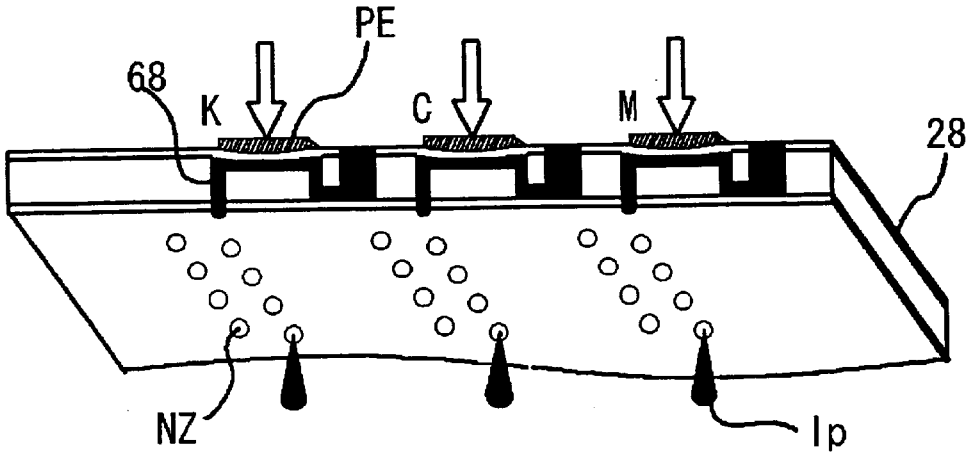
FIG. 5 shows the principle of dot creation in the printer shown in FIG. 1.

FIG. 5 shows the principle of dot creation by the print head 28. For clarity of illustration, only the part relating to the ink ejection with regard to the black (K), cyan (C), and magenta (M) inks is illustrated in FIG. 5. When the ink cartridges 71 and 72 are attached to the carriage 31, the inks of the respective colors are fed through the ink conduits 68 shown in FIG. 5 to the respective ink ejection heads 61 through 64.

In the ink ejection heads 61 through 64, a piezoelectric element PE is arranged corresponding to each nozzle. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric element PE for a predetermined time on period, the piezoelectric element PE is expanded for the predetermined time period to deform one side wall of the ink conduit 68 as shown by the arrows in FIG. 5. The volume of the ink conduit 68 is reduced according to the expansion of the piezoelectric element PE. A certain amount of ink corresponding to the reduction is ejected as an ink particle Ip from the nozzle Nz at a high speed. The ink particles Ip soak into the printing paper P set on the platen 26, so as to implement printing.

Figure 6:
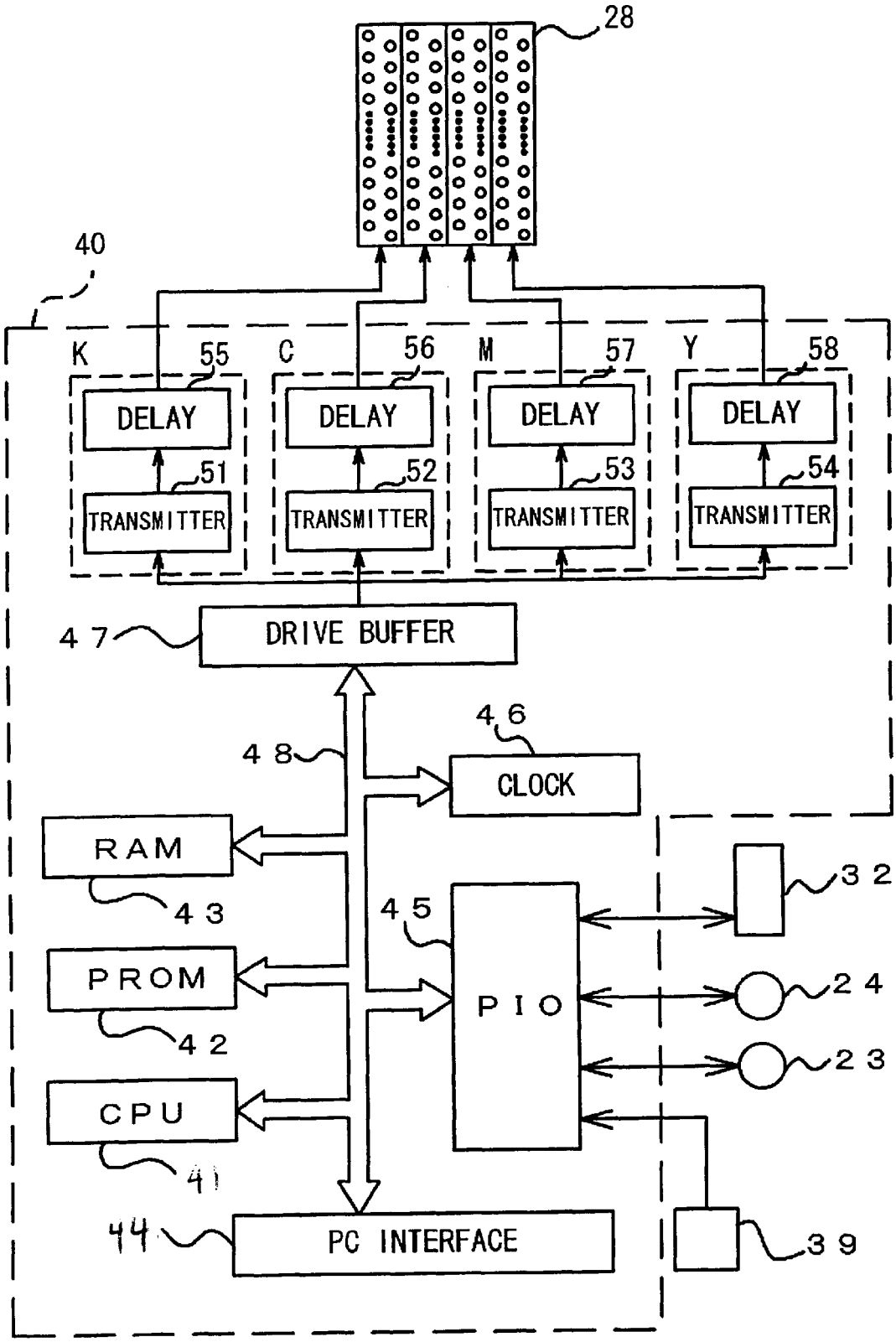
FIG. 6 schematically illustrates the structure of a control circuit included in the printer shown in FIG. 1.

The following describes the internal structure of the control circuit 40. FIG. 6 shows the internal structure of the control circuit 40. The control circuit 40 includes a CPU 41, a PROM 42, a RAM 43, and a diversity of circuits discussed below, which are mutually connected via a bus 48. A PC interface 44 is in charge of transmission of data to and from the computer 90. A peripheral input-output unit (PIO) 45 is in charge of transmission of signals to and from the sheet feed motor 23, the carriage motor 24, and the control panel 32. A clock 46 synchronizes the operations of the respective circuits. A drive buffer 47 outputs signals representing the dot on-off conditions of the respective nozzles to the ink ejection heads 61 through 64.

The control circuit 40 includes transmitters 51 through 54 and delay circuits 55 through 58 respectively mapped to the ink ejection heads 61 through 64 of the respective colors. The transmitters 51 through 54 periodically output driving waveforms for applying the voltages to the piezoelectric elements of the ink ejection heads 61 through 64 after a predetermined time period has elapsed since a start of the main scan. The timings of starting the output of the driving waveforms are registered in the PROM 42. The printer 22 enables the bidirectional recording so that the timings of starting the output of the driving waveforms are registered individually with regard to the forward pass and the backward pass of the main scan.

The driving waveforms output from the transmitters 51 through 54 are delayed by predetermined delay times set for the respective colors by the delay circuits 55 through 58 and output to the ink ejection heads 61 through 64. The preset delay times with regard to the respective colors are registered in the PROM 42. Each of the delay circuits 55 through 58 is designed to output the driving waveform when the number of pulses input from the clock 46 into a counter circuit reaches a preset value stored in the PROM 42. The signals with regard to the respective colors input from the drive buffer 47 to the transmitters 51 through 54 are output to the active nozzles set in the dot-on state at the timings adjusted by the delay circuits 55 through 58. The active nozzles included in the ink election heads 61 through 64 respectively eject ink and create dots, based on the driving waveforms.

In the printer 22 having the hardware structure discussed above, while the sheet feed motor 23 feeds the sheet of printing paper P (hereinafter referred to as the sub-scan), the carriage motor 24 reciprocates the carriage 31 (hereinafter referred to as the main scan), simultaneously with actuation of the piezoelectric elements PE on the respective ink ejection heads 61 through 64 of the print head 28. The printer 22 accordingly ejects the respective color inks to create dots and thereby forms a multi-color image on the printing paper P.

In this embodiment, the printer 22 has the print head that uses the piezoelectric elements PE to eject ink as discussed previously. The printer may, however, apply another method for ink ejections The technique of the present invention is applicable, for example, to a printer that supplies electricity to a heater disposed in an ink conduit and utilizes the bubbles generated in the ink conduit to eject ink.

B. Dot Creation Routine

Figure 7:
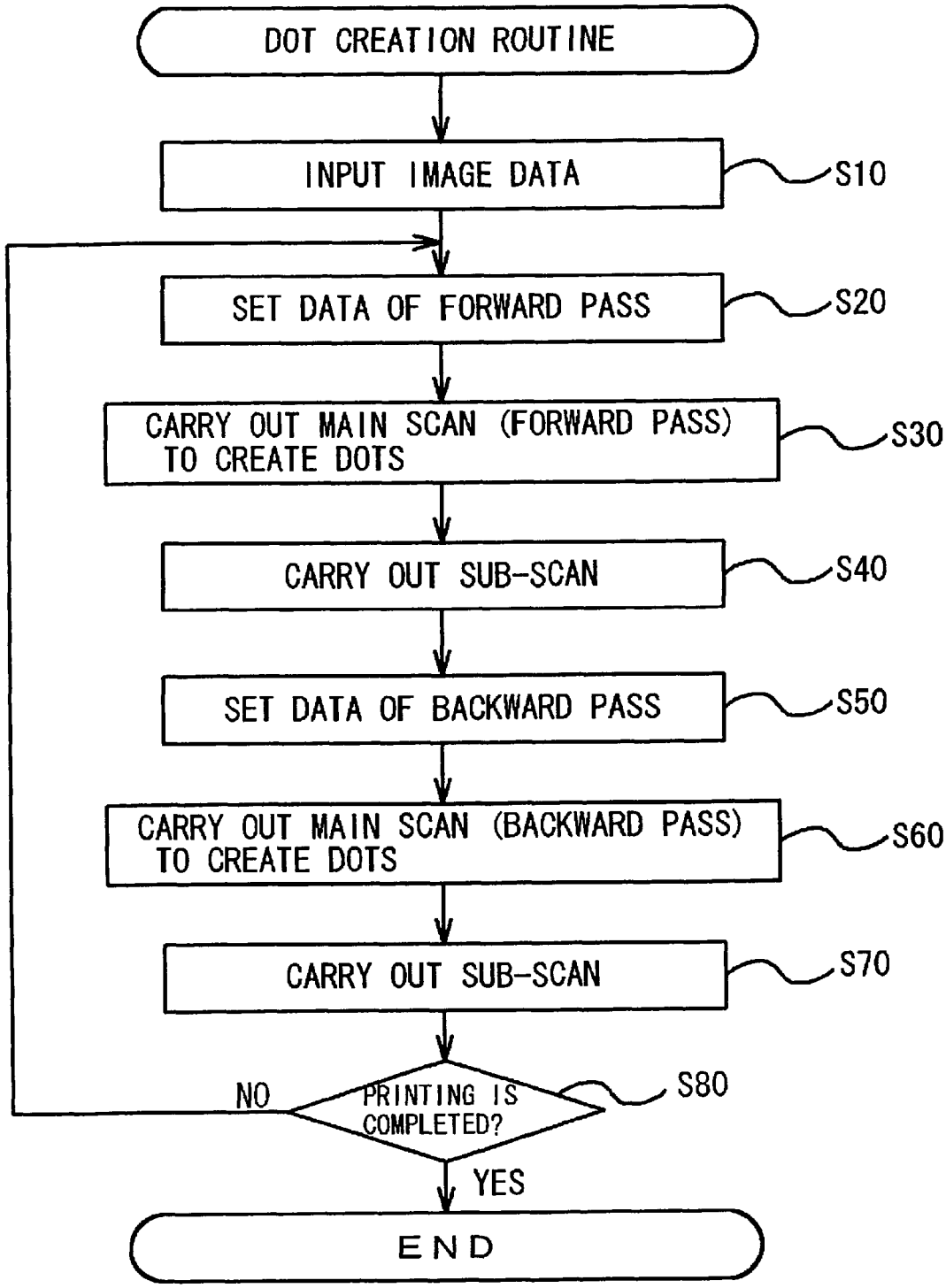
FIG. 7 is a flowchart showing a dot creation routine.

The following describes a series of control processing executed when the printer 22 prints an image. FIG. 7 is a flowchart showing a dot creation routine. This routine is executed by the CPU 41 included in the control circuit 40 of the printer 22 in response to an instruction output from the printer driver 96. The series of the processing discussed here corresponds to one specification of print mode, in which dots are created in both a forward pass and a backward pass of main scan. The printer 22 may, however, create dots only in one pass of the main scan according to another specification of print mode.

When the program enters this routine, the CPU 41 first receives image data (step S10). The image data have been processed by the printer driver 96 and specify the dot on-off conditions of each color ink in the respective pixels.

The CPU 41 sets data with regard to the forward pass of the main scan based on the input image data (step S20). The procedure of step S20 transfers data, which specify the on-off conditions of dots to be created in the forward pass of the main scan, to the drive buffer 47. After setting the data for the forward pass, the CPU 41 creates dots by moving the carriage 31 in the forward direction as the main scan (step S30). The printer 22 has forty-eight nozzles for each color so that forty eight raster lines are formed by the processing of step S30.

The CPU 41 subsequently performs a sub-scan (step S40). The sub-scan feeds a sheet of printing paper by a predetermined feeding quantity, which has been set in advance according to the specification of print mode. The CPU 41 then sets data with regard to the backward pass of the main scan in the drive buffer 47 (step S50). To shorten the total processing time, the data for the backward pass are set partially in parallel with the sub-scan. After setting the data for the backward pass, the CPU 41 creates dots by moving the carriage 31 in the backward direction as the main scan (step S60), and subsequently performs the sub-scan (step S70). This series of processing is repeated until the completion of printing (step S80), that is, until the end of the input image data.

Figure 8:
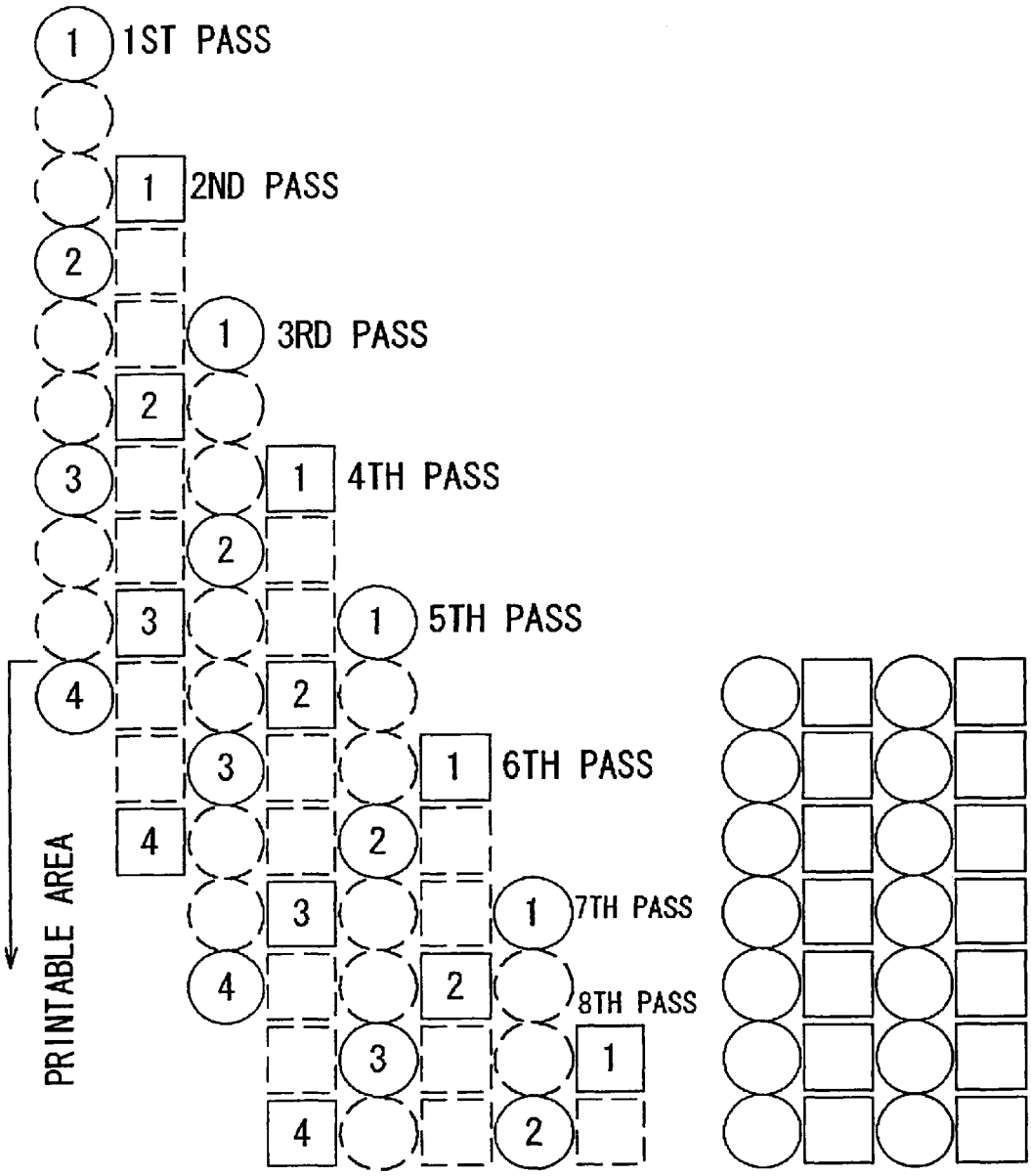
FIG. 8 shows a process of dot creation.

FIG. 8 shows an example of printing by the bidirectional recording technique. Circles and squares with numerals therein represent the positions of the nozzles in the sub-scanning direction in each pass of the main scan. For the convenience of illustration, this example uses a print head having four nozzles arranged at a nozzle pitch of 3 dots. The numerals denote nozzle numbers allocated to the respective nozzles. The nozzles shown by the circles create dots in the forward pass of the main scan, whereas the nozzles shown by the squares create dots in the backward pass of the main scan.

Dots are recorded in both the forward pass and the backward pass of the main scan, while the sub-scan is carried out by a fixed feeding quantity of 2 dots. This results in printing an image in a printable area shown in FIG. 8. The rightward drawing shows resulting dots thus created. The dots shown by the circles represent those recorded in the forward pass of the main scan, whereas the dots shown by the squares represent those recorded in the backward pass of the main scan. In this example, each raster line is recorded with two different nozzles. As clearly understood from the illustration, the dots recorded in the forward pass and the dots recorded in the backward pass are thus arranged alternately to complete an image. Each raster line may, however, be formed only in the forward pass or in the backward pass of the main scan by regulating the feeding quantity of sub-scan.

C. Adjustment of Dot Creation Timings

Figure 9:
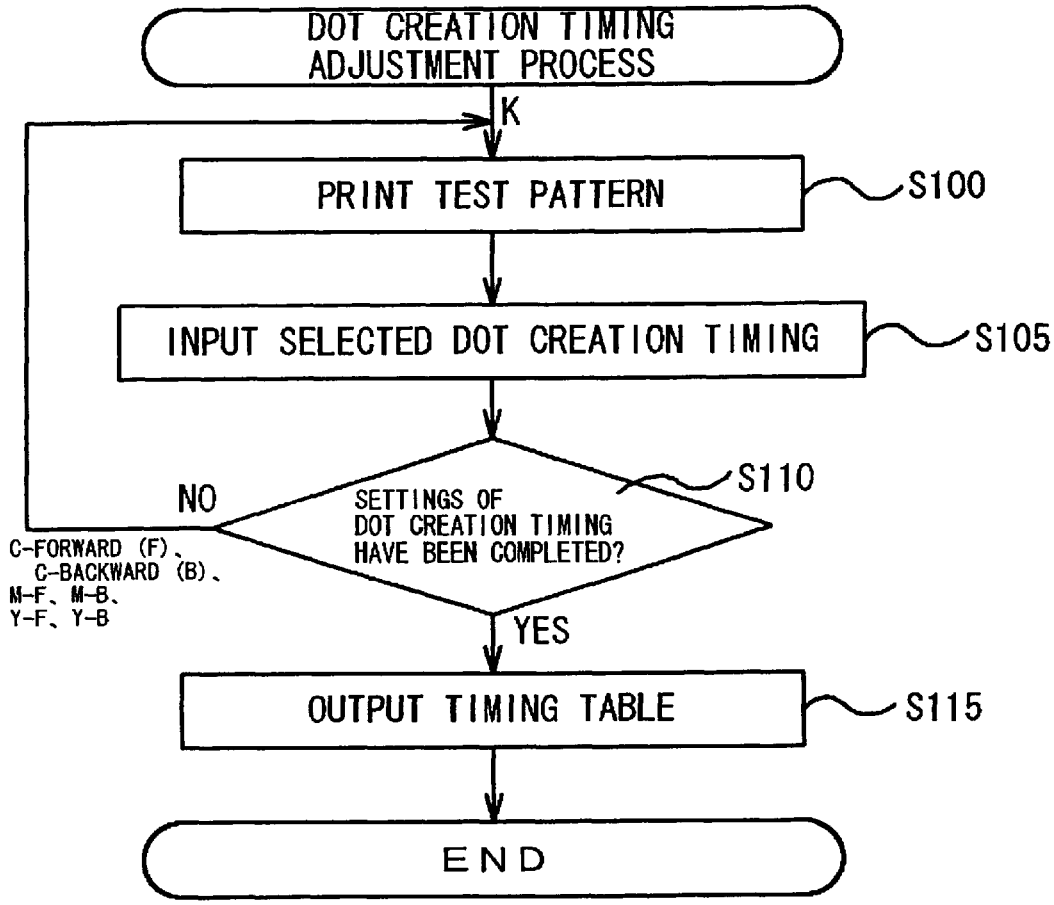
FIG. 9 is a flowchart showing a routine of dot creation timing adjustment process.
Figure 1:
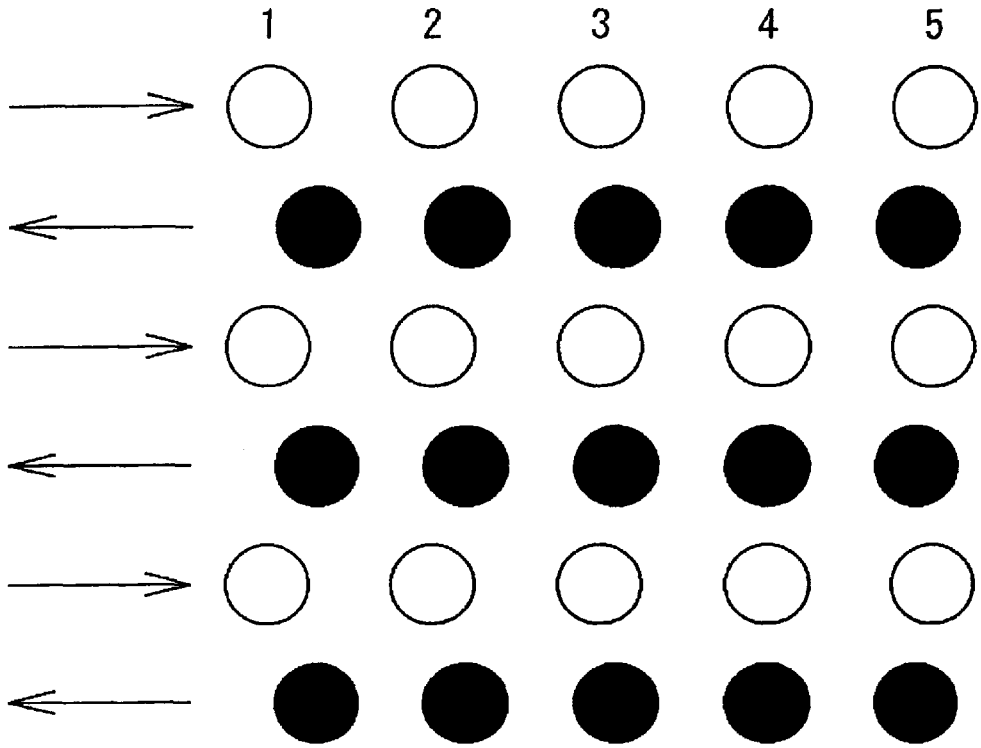
Figure 1:
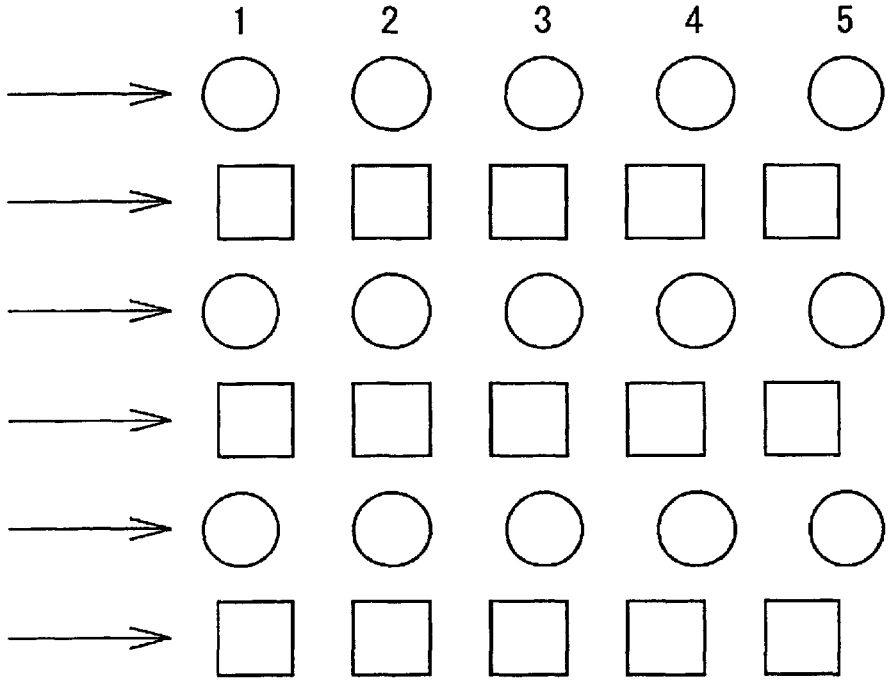

In the printing apparatus of this embodiment, the dot creation timing is adjustable with regard to each color ink in the case of bidirectional recording. Such adjustment is implemented by execution of a series of a dot creation timing adjustment process in the printer driver 96. FIG. 9 is a flowchart showing a routine of dot creation timing adjustment process. The CPU 81 of the computer 90 executes this series of the processing.

When the program enters this routine, the CPU 81 first adjusts the timing of dot creation with regard to the black ink (K). For this purpose, a predetermined test pattern is printed first with regard to the black K (step S100). The procedure causes the printer 22 to print the predetermined test pattern according to the series of the processing discussed previously with the flowchart of FIG. 7, based on the data for the test pattern stored in the ROM 82 and output to the printer 22.

FIG. 10 shows an example of the test pattern printed here. Open circles represent dots created in the forward pass of the main scan, whereas closed circles represent dots created in the backward pass of the main scan. The test pattern is recorded by varying the dot creation timing in the backward pass in five stages, which are respectively shown by numbers '1' through '5'. The dot creation timing is varied by varying the delay time set in each of the delay circuits 55 through 58. In response to the instruction to print the test pattern, the CPU 41 of the control unit 40 employs the values specified by the printer driver 96 instead of the value stored in the PROM 42 as the delay time in the backward pass. The stepwise variation in delay time causes the dot recording position in the backward pass to be shifted leftward or rightward relative to the dot recording position in the forward pass as shown in the test pattern of FIG. 10.

The user of the printer 22 selects a desired dot creation timing that gives an image of optimum quality to the recorded test pattern. The CPU 81 subsequently inputs a number allocated to the selected dot creation timing (step S105). In the example of FIG. 10, at the timing with the number '4', the dot recording position in the forward pass is coincident with the dot recording position in the backward pass. The CPU 81 accordingly inputs the value '4' as the selected dot creation timing. The input data are registered in the form of a timing table in the RAM 83.

The CPU 81 then determines whether or not the settings of the dot creation timing have been completed (step S110). This embodiment requires the adjustment of the dot creation timing with regard to all the color inks, that is, cyan, magenta, and yellow in addition to black. At this moment, the adjustment of the dot creation timing has been completed only for the black ink. The CPU 81 accordingly determines that the settings of the dot creation timing have not yet been completed and shifts to the processing to adjust the dot creation timing with regard to the cyan ink.

The dot creation timing with regard to the cyan ink is adjusted in the same manner as that for the black ink. The CPU 81 first prints the predetermined test pattern (step S100). The dot creation timing of the cyan ink is regulated relative to that of the black ink as the standard. An example of the test pattern printed here is shown in FIG. 11. Circles represent dots of the black ink created in the forward pass of the main scan, whereas squares represent dots of the cyan ink created in the forward pass. Like the test pattern shown in FIG. 10, the cyan dots are created by varying the dot creation timing in a stepwise manner.

The optimum dot creation timing is selected out of the printed test pattern so that the dot creation timing of the cyan ink in the forward pass is made coincident with the dot creation timing of the black ink in the forward pass. The user of the printer 22 specifies the desired dot creation timing for the cyan ink in the same manner as that for the black ink. The CPU 81 inputs the specified dot creation timing (step S110) and stores the input data in the form of the timing table in the RAM 83. In the example of FIG. 1, at the timing with the number '2', the dot recording position of the black ink is coincident with the dot recording position of the cyan ink. The value '2' is accordingly input as the selected dot creation timing.

The CPU 81 subsequently performs the adjustment of the dot creation timing of the cyan ink in the backward pass of the main scan. This time the dots represented by the squares in the test pattern of FIG. 11 are created in the backward pass of the main scan with regard to the cyan ink. In a similar manner, the dot creation timings in the forward pass and in the backward pass of the main scan are individually adjusted with regard to the magenta ink and the yellow ink. When the adjustment of the dot creation timing has been completed for all the color inks in both the forward pass and the backward pass of the main scan (step S110), the timing table including the results of the adjustment is output to the printer 22 (step S115). The timing table is stored in the PROM 83 of the printer 22 and defines the dot creation timings in the subsequent printing operations.

FIG. 12 shows an example of the timing table set in this embodiment. The timing table specifies the dot creation timings of the respective color inks in both the forward pass and the backward pass of the main scan relative to the dot creation timing of the black ink in the forward pass as the standard. As shown in FIG. 10, the dot creation timing No. 4 is adequate as the dot creation timing of the black ink K in the backward pass. The value '4' is accordingly registered in the timing table. The values specifying the adequate dot creation timings in the forward and the backward passes are registered for the other color inks. The technique of the embodiment modifies the values in the timing table as discussed below and then stores the modified timing table in the PROM 83 of the printer 22. The dot creation timings in the subsequent printing operations are determined according to these values in the timing table.

Before storing the timing table in the PROM 83, the technique of the embodiment changes the standard dot creation timing in the timing table from the forward pass of the black ink to the earliest dot creation timing. FIGS. 13(*a*) and 13(*b*) show variations in dot creation timing. The numbers '1' through '5' representing the dot creation timings or dot recording positions in FIGS. 13(*a*) and 13(*b*) correspond to the numbers allocated to the test patterns shown in FIGS. 10 and 11. FIG. 13(*a*) shows creation of dots in the forward pass of the carriage 31. For example, to create a dot at the position No. 5, an ink droplet should be ejected at a relatively early timing in the course of the movement of the carriage 31. To create a dot at the position No. 1, on the other hand, an ink droplet should be ejected at a relatively late timing in the course of the movement of the carriage 31. The dot creation timing of the black ink K in the forward pass set as the standard corresponds to the dot recording position No. 3.

FIG. 13(*b*) shows creation of dots in the backward pass of the carriage 31. On the contrary to the forward pass, in the backward pass, to create a dot at the position No. 1, an ink droplet should be ejected at a relatively early timing. To create a dot at the position No. 5, on the other hand, an ink droplet should be ejected at a relatively late timing.

From this point of view, comparison is made among the dot formation timings of the respective color inks in the forward pass and the backward pass of the main scan. The procedure of the comparison is described with the timing table shown in FIG. 12. As the results of the comparison among the dot creation timings based on the criteria discussed above, the yellow ink has the earliest dot creation timings both in the forward pass and in the backward pass of the main scan in the case of the table of FIG. 12. The dot creation timings of the yellow ink in the forward pass and in the backward pass are respectively earlier by one stage than the standard dot creation timing.

The standard dot creation timing is accordingly changed to the dot creation timings of the yellow ink in the forward pass and the backward pass of the main scan. The new settings of the dot creation timing causes the dot creation timing of the black ink K in the forward pass, which was set as the standard in the process of printing the test pattern, to be later by one stage than the dot creation timing of the yellow ink in the forward pass. In a similar manner, the dot creation timings of the cyan ink and the magenta ink in the forward pass are later by two stages and by one stage than the dot creation timing of the yellow ink, respectively. In a similar manner, the delay times of the other color inks in the backward pass are set relative to the dot creation timing of the yellow ink as the standard.

The dot creation timings are then modified relative to the new standard according to an algorithm discussed below. In the case of the forward pass, the modified dot recording timing is determined by the equation of 'new standard dot creation timing'—'original dot creation timing'. In the example of FIG. 12, the new standard dot creation timing in the forward pass is specified by the value '4' for the yellow ink. The original dot creation timing for the black ink has the value '3'. The modified dot creation timing for the black ink is accordingly equal to the value '1' by the equation of 4–3=1.

In the case of the backward pass, on the other hand, the modified dot creation timing is determined by the equation of 'original dot creation timing'—'new standard dot creation timing'. In the example of FIG. 12, the new standard dot creation timing in the backward pass is specified by the value '2' for the yellow ink. The original dot creation timing for the black ink has the value '4'. The modified dot creation timing for the black ink is accordingly equal to the value '2' by the equation of 4–2=2.

The change of the standard dot creation timing causes a misalignment of the dot recording positions in the forward pass with the dot recording positions in the backward pass. The dot creation timings of the respective color inks in the backward pass registered in the timing table of FIG. 12 are set relative to the dot creation timing of the black ink K in the forward pass as the standard. Changing the standard dot creation timing in the forward pass to the dot creation timing for the yellow ink causes the dots of the black ink K to be created in the forward pass at the later timing by one stage than the corresponding dot creation timing in the process of printing the test pattern. This means that the dot of the black ink K in the forward pass are shifted rightward by one in FIG. 13(*a*). It is accordingly required to advance the respective dot creation timings in the backward pass by one stage. The control circuit 40 in the printer 22 shortens the time period between the start of the main scan in the backward pass stored in the PROM 83 and the start of the output of the driving waveforms, thereby attaining the advancement of the dot creation timings in the backward pass by one stage.

The printing apparatus of this embodiment enables the adjustment of the dot creation timings with regard to the respective color inks in both the forward pass and the backward pass of the main scan in the case of bidirectional recording. This arrangement enables the dot recording positions of the respective colors to be made coincident with one another with a high accuracy, thus attaining the high-quality printing. The technique of the embodiment simply specifies the adequate dot creation timings in the printed test pattern, in order to implement the adjustment. This enables the user to readily perform the adjustment in the event that the dot creation timings become inadequate due to any factors arising after the manufacture and the shipment of the printer 22.

The printing apparatus of this embodiment adjusts the dot creation timings of the respective inks relative to the earliest dot creation timing. This arrangement ensures the adequate adjustment of the dot creation timings in a wide range. For example, if the dot creation timing in the forward pass for the black ink is fixed to the standard dot creation timing, there is an undesirable restriction in the dot creation of the other color inks at the earliest timings than the timing for the black ink. The technique of the embodiment, on the other hand, sets the earliest dot creation timing as the standard and thereby enables the dot creation timings of the respective colors to be adjusted in the wide range without the undesirable restriction.

The method of adjusting the dot creation timings discussed above is only an example, and a diversity of other methods are applicable for the same purpose. One applicable method repeats the cycle of inputting a specified dot creation timing and printing a test pattern at the specified dot creation timing so as to refine the dot creation timing. The functions executed by the computer 90, the printer driver 96, and the input unit 92 in the embodiment may be incorporate in the printer 22. In this case, the printer 22 alone can implement the adjustment of the dot creation timings.

FIG. 14 shows other processes of adjusting the dot creation timing as modifications of the embodiment. The table of FIG. 14 defines the relationship between the standard set in the adjustment of the dot creation timing and the objects to be adjusted. In the embodiment discussed above, the user specifies the dot creation timing of the black ink K in the forward pass as the standard and adjusts the dot creation timing of the black ink K in the backward pass and the dot creation timings of the cyan, magenta, and yellow inks in both the forward pass and the backward pass. In this case, the total of seven test patterns are printed.

In modification 1, the dot creation timings of the respective colors other than yellow in both the forward pass and the backward pass are adjusted relative to the dot creation timing of the black ink K in the forward pass. In this case, the dot creation timings of the yellow ink may be set equal to those of the black ink K or fixed to preset standard timings. This arrangement reduces the number of the test pattern to be printed and shortens the time period required for the adjustment of the dot creation timings. In the case of the yellow color, misalignment of the dot recording positions is relatively inconspicuous and does not have significant effects on the picture quality of the resulting printed image. Namely omitting the adjustment of the dot creation timings for the yellow ink does not lead to significant deterioration of the picture quality of the resulting printed image.

The adjustment of the dot creation timings may be omitted for any color other than yellow as long as the color does not have significant effects on the picture quality of the resulting printed image. While the printer 22 of the embodiment uses the four color inks as discussed previously, some printers use six color inks including light cyan ink and light magenta ink having lower densities. In such printers, the adjustment of the dot creation timings may be omitted for these light inks of lower densities.

In modification 2 shown in FIG. 14, the dot creation timings may be adjusted individually for the respective color inks. In the same manner as the adjustment of the dot creation timing of the K ink in the backward pass relative to that in the forward pass set as the standard, the dot creation timings of the C, M, and Y inks in the backward pass are adjusted relative to those in the forward pass set as the standards. In the printer that does not cause any significant difference in dot creation timing among different colors, this method is preferably adopted to readily adjust the dot creation timings and improve the picture quality of the resulting printed image.

In modification 3 shown in FIG. 14, the difference in dot creation timing between the forward pass and the backward pass is regulated only for the K ink, and the difference in dot creation timing among the respective color inks is regulated only in the forward pass. This process collectively adjusts the difference in dot creation timing between the forward pass and the backward pass with regard to all the color inks, based on the results of the adjustment for the K ink. In the case where the difference in dot creation timing between the forward pass and the backward pass is ascribed to the specific factors having no significant difference among the respective color inks, such as the backlash or the thickness of printing paper, this method is preferably adopted to readily adjust the dot creation timings and improve the picture quality of the resulting printed image.

A variety of other combinations may be applied to adjust the dot creation timings. For example, the adjustment with regard to the yellow ink may be excluded from the modifications 2 and 3. The modifications 2 and 3 may be performed in parallel. The user may select a desired process or a combination thereof among the variety of processes applicable to adjust the dot creation timings.

FIG. 14 shows the applicable processes to adjust the dot creation timings in the case of bidirectional recording. The process of the modification 3 shown in FIG. 14 without the adjustment for the K ink in the backward pass is applicable to adjust the dot creation timings of the respective color inks in the printer that performs printing only in the forward pass of the main scan. The variety of modifications set in the case of bidirectional recording are also applicable to the case of unidirectional recording. For example, the adjustment of the dot creation timings may be omitted for the Y ink. In another example, the dot creation timings may be adjusted collectively for the C, M, and Y inks.

There are a variety of test patterns other than those shown in FIGS. 10 and 11. For example, misalignment of the dot recording positions may be visually recognizable as an unevenness of density in the whole area of the test pattern. FIGS. 15(*a*) and 15(*b*) show an example of such test patterns. Open circles represent dots created in the forward pass of the main scan, whereas closed circles represent dots created in the backward pass of the main scan. FIG. 15(*a*) shows the test pattern recorded at the adequate dot creation timings in the forward pass and the backward pass. In this case, dots are created in a regular manner in a certain area. This is visually recognized as a homogeneous density. FIG. 15(*b*) shows the test pattern in which dots created in the backward pass are shifted rightward. In this case, the certain area is visually recognized to have an unevenness of the density. FIGS. 15(*a*) and 15(*b*) show only one example. A variety of other test patterns may be applied to detect the difference in dot creation timing as an unevenness of the density.

Figure 16A:
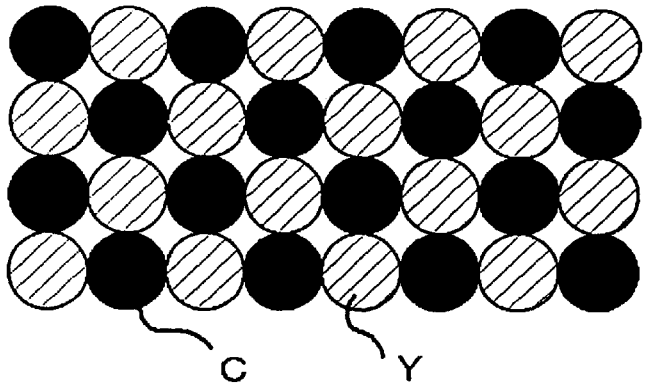
FIGS. 16(*a*) and 16(*b*) show a second modified example of the test pattern.
Figure 16B:
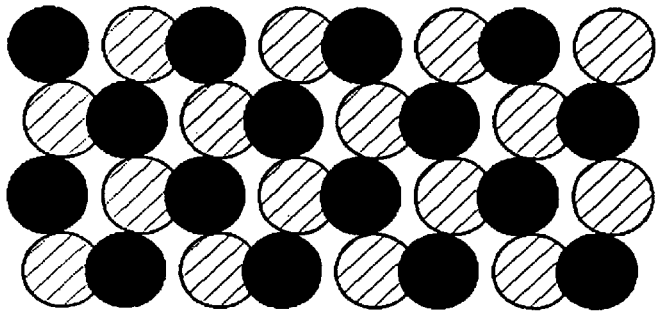
Figure 1:
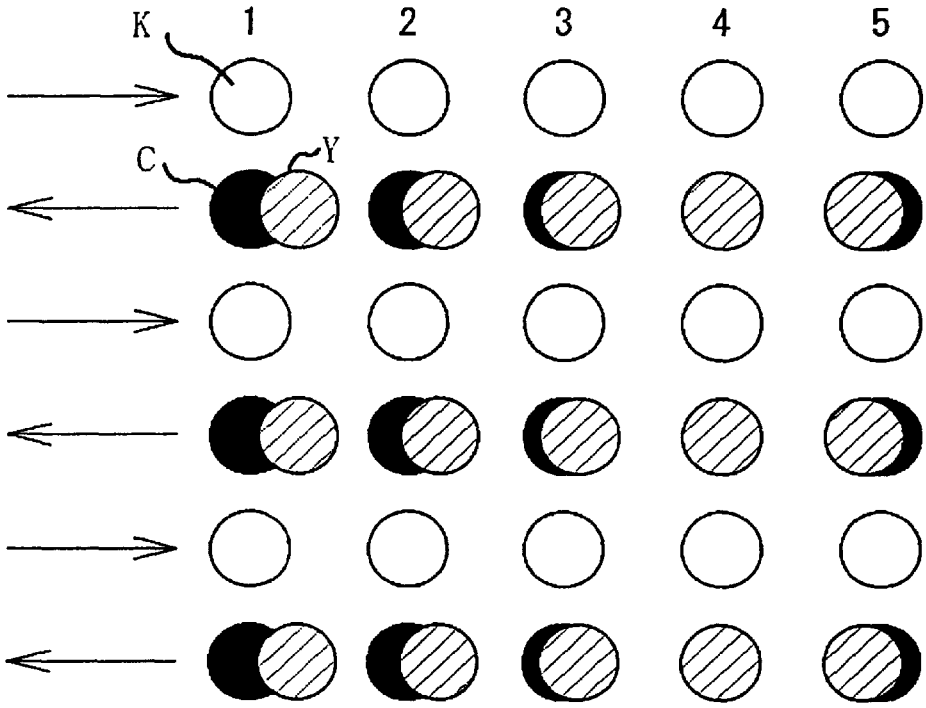
Figure 1:
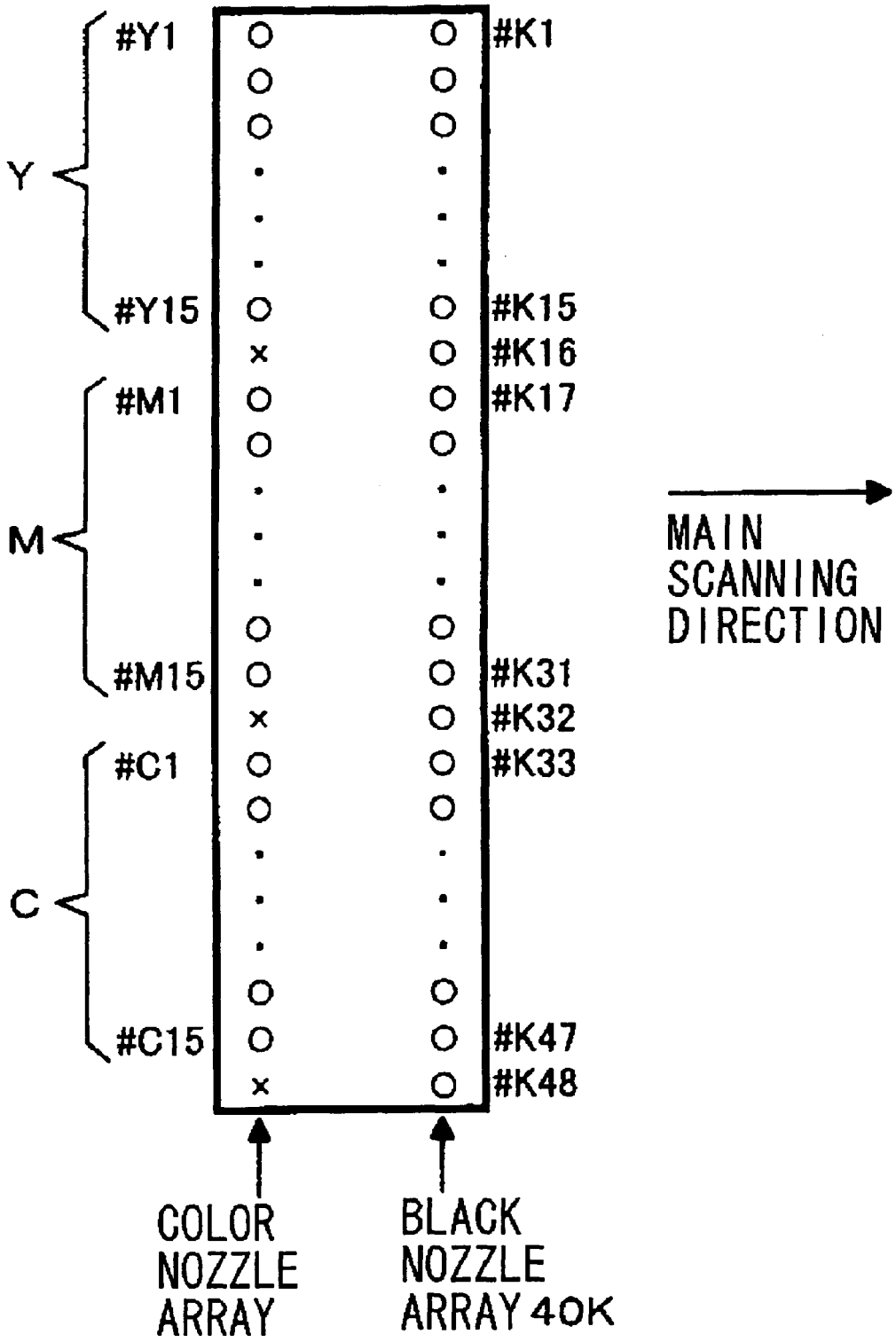
Figure 1:
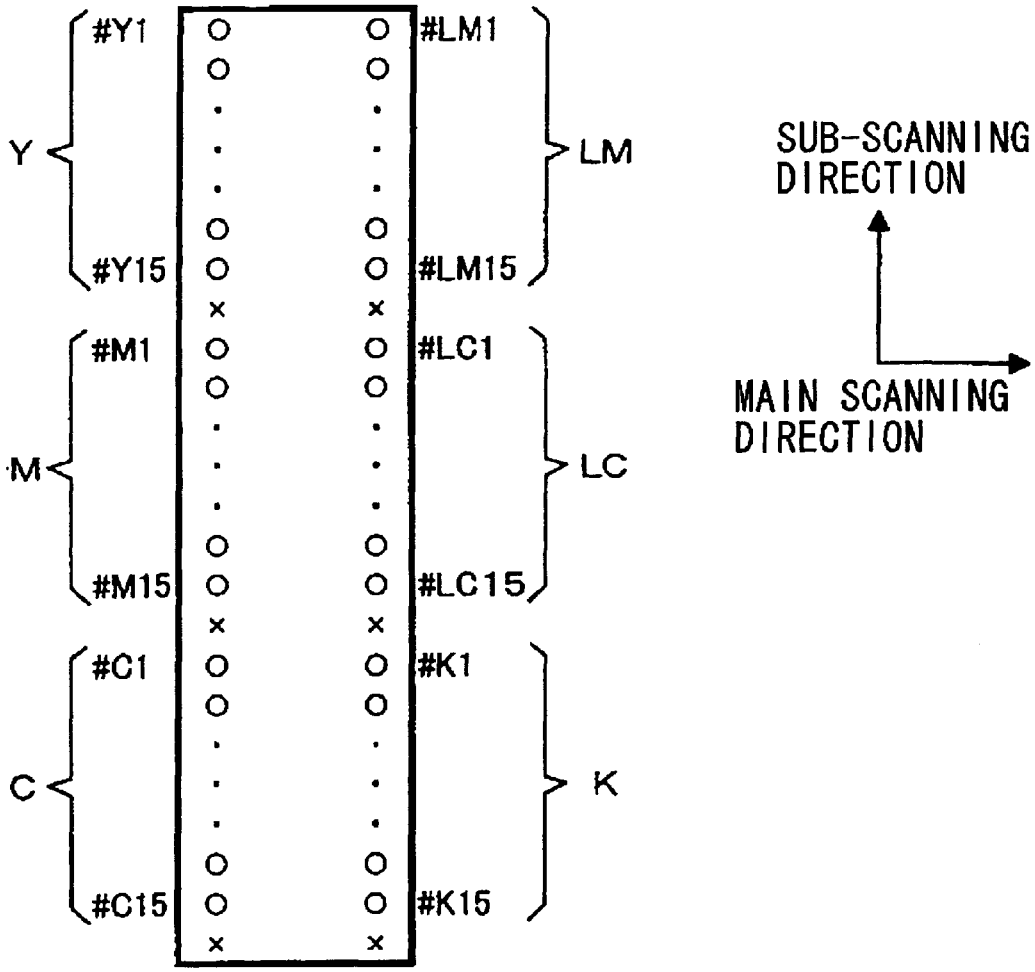
Figure 2:
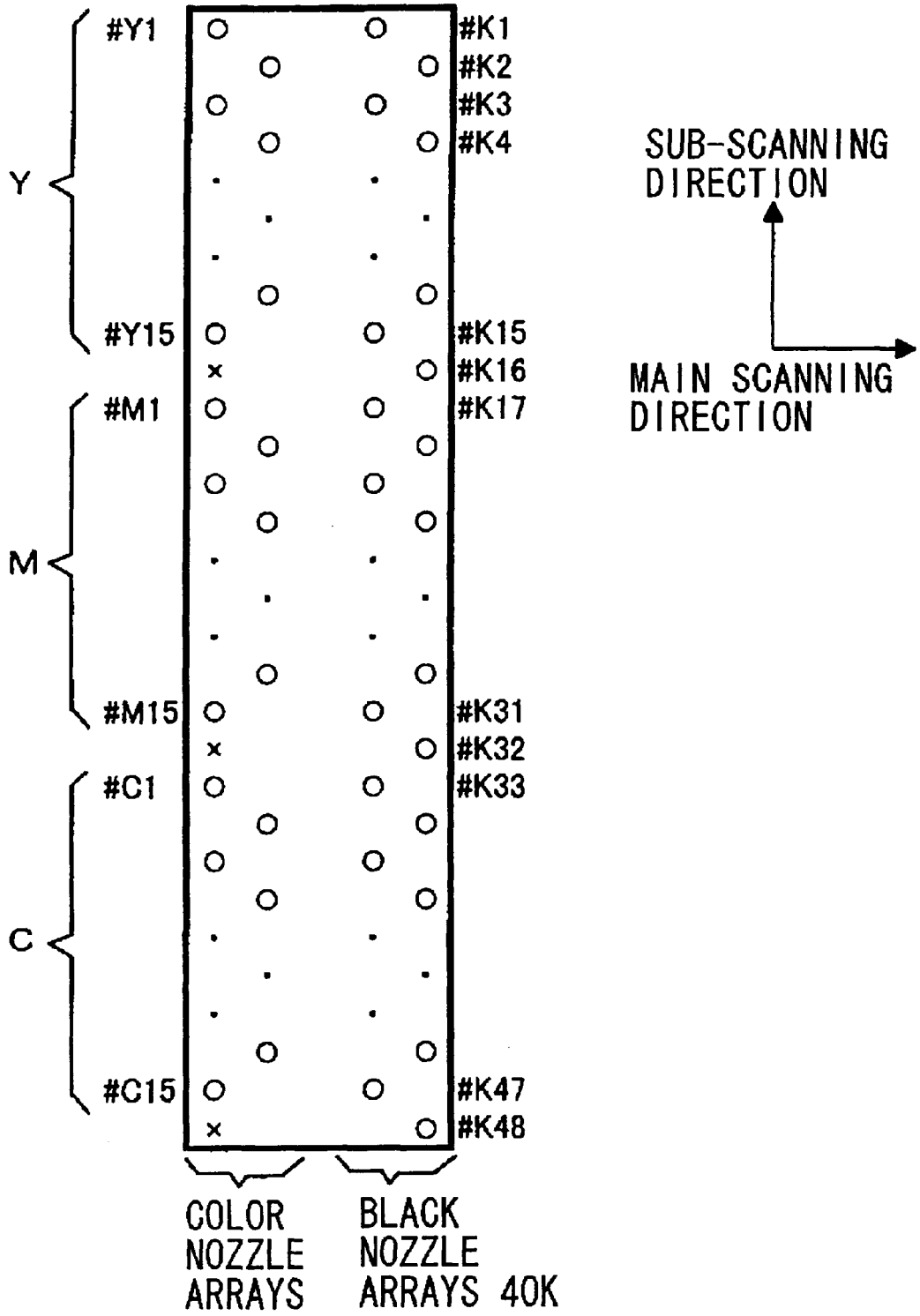
Figure 21A:
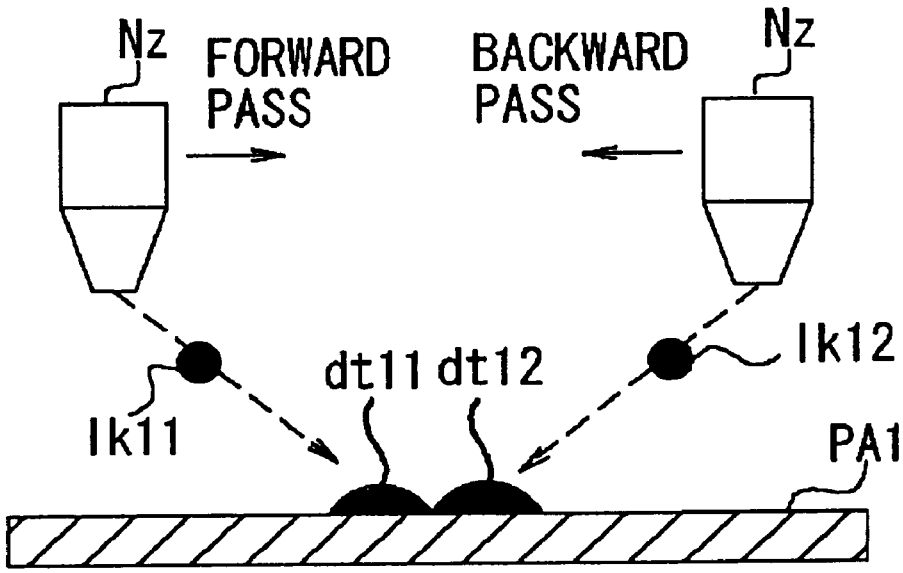
FIGS. 21(*a*) and 21(*b*) shows misalignment of the positions of dot creation in the case of bidirectional recording.
Figure 21B:
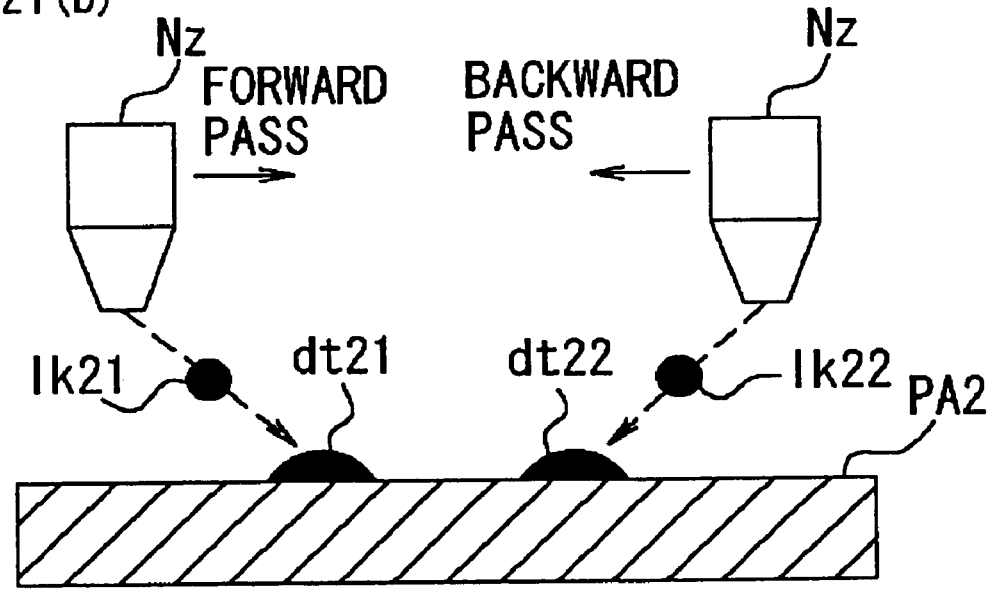

In another example, the test pattern may include dots of a specific color having the low visual conspicuousness, such as the yellow color, created with dots of another color to enhance the visual conspicuousness. Since the dots of the yellow color have a high lightness, the misalignment of the dot recording positions is not easily recognized. There is accordingly a difficulty in regulating the dot creation timing for the yellow ink with a high accuracy. FIGS. 16(*a*) and 16(*b*) show an example of the test pattern used to enhance the visual conspicuousness of the yellow ink. Closed circles represent the dots of the cyan ink, and hatched circles represent the dots of the yellow ink. FIG. 16(*a*) shows the state in which the yellow dots are created at the adequate positions. In this state, the whole area of the printed test pattern is visually recognized to have homogeneous green color. FIG. 16(*b*) shows the state in which the positions of the yellow dots are shifted rightward. In this case, the uneven density of the green color is observed in the area of the printed test pattern. Since the green color has the higher visual conspicuousness than the yellow color, the dot creation timing of the yellow ink can be adjusted adequately.

There are a variety of other test patterns applicable to enhance the visual conspicuousness of the yellow ink. FIG. 17 shows another example of the test pattern. In the example of FIG. 17, the test pattern is printed by creating the yellow dots and the cyan dots in an overlapping manner. Open circles represent reference dots used to adjust the dot creation timing of the yellow ink. In this case, the open circles denote the black dots created in the forward pass of the main scan. Hatched circles represent the yellow dots, and closed circles represent the cyan dots. In the test pattern shown in FIG. 17, the cyan dots and the yellow dots are created in an overlapping manner. Since the dot creation timing has already been adjusted with regard to the dots of the cyan ink, there is a misalignment of the yellow dots with the cyan dots. In this test pattern, the yellow dots created at the adequate dot creation timing (that is, the timing No. 4) are visually recognized as green dots. The yellow dots created at other dot creation timings are observed, however, as combinations of green in overlapped areas and cyan in non-overlapped areas. The creation of the cyan dots and the yellow dots in an overlapping manner enhances the visual conspicuousness of the yellow dots and ensures the adequate adjustment of the dot creation timing with regard to the yellow ink.

Other patterns are also applicable for the same purpose. For example, on the premise that the adjustment of the dot creation timing for the yellow ink is performed after the adjustment of the dot creation timing for the cyan ink, a test pattern of yellow dots is printed on a solid area of cyan. Magenta may alternatively be employed as the color used with yellow.

The embodiment discussed above regards the printing apparatus. The principle of the present invention is, however, actualized in a variety of applications other than the printing apparatus. One possible application is a recording medium, in which the program for printing any of the diversity of test patterns discussed in the embodiment is recorded. Another possible application is a recording medium, in which the program for successively printing any of such test patterns and performing the adjustment of the dot creation timing is recorded. The computer connected to the printer executes the program recorded in such recording media to perform the adjustment of the dot creation timings in the same manner as the printing apparatus of the embodiment, thereby attaining the high-quality printing. The test patterns for enhancing the low visual conspicuousness of the dots are applicable to the case of unidirectional recording as well as to the case of bidirectional recording.

D. Modifications

In the embodiment discussed above, the nozzle groups for the respective colors are arranged in parallel in the main scanning direction as shown in FIG. 4. The principle of the present invention is, however, not restricted to such arrangement of the nozzle groups for the respective colors. FIG. 18 shows another print head as a first modified example. The print head has two nozzle arrays. Nozzles #K1 through #K48 located on the right side of the drawing eject black ink. On the left side of the drawing, 15 nozzles #Y1 through #Y15 for ejecting yellow ink, 15 nozzles #M1 through #M15 for ejecting magenta ink, and 15 nozzles #C1 through #C15 for ejecting cyan ink are aligned. There is a vacancy corresponding to one nozzle pitch between the nozzle groups of yellow and magenta and between the nozzle groups of magenta and cyan. The technique of the present invention is applicable to the print head having the nozzle groups for the respective colors in such configuration. As clearly understood from this modified example, the respective nozzle groups may include different numbers of nozzles.

FIG. 19 shows still another print head as a second modified example. Like the first modified example, the print head of the second modified example has two nozzle arrays aligned in the sub-scanning direction. The left nozzle array has the same structure as that of the first modified example. The right nozzle array includes 15 nozzles #LM1 through

#LM15 for ejecting light magenta ink, 15 nozzles #LC1 through #LC15 for ejecting light cyan ink, and 15 nozzles #K1 through #K15 for ejecting black ink. The technique of the present invention is applicable to the print head having the nozzle groups for the respective colors in such configuration.

FIG. 20 shows another print head as a third modified example. The print head of the third modified example has four nozzle arrays aligned in the sub-scanning direction. The right two nozzle arrays are black nozzle arrays for ejecting black ink, whereas the left two nozzle arrays are color nozzle arrays for ejecting yellow, magenta, and cyan inks. The two black nozzle arrays are shifted by half the nozzle pitch in the sub-scanning direction. The two color nozzle arrays are arranged in a similar manner. The technique of the present invention is applicable to the print head having the nozzle groups for the respective colors in such configuration.

In the technique of the present invention, the nozzle groups may be defined by a diversity of factors, instead of by the colors.

For example, in the respective print heads shown in FIG. 4 and FIGS. 18 through 20, each nozzle array aligned in the sub-scanning direction may be treated as one nozzle group. The respective nozzle arrays have different ink ejection timings to create a dot in a certain pixel. Setting the respective nozzle arrays to the nozzle groups enables the dot recording position to be adjusted with a high accuracy.

In another example, each nozzle group may be set corresponding to each actuator for driving the nozzles. As discussed previously with FIG. 5, each nozzle is driven by a piezoelectric element. In some manufacturing process, a plurality of piezoelectric elements are grouped to an actuator, and a plurality of actuators are arranged in the print head. The actuators may, however, not correspond to the ink colors or the nozzle arrays. For example, in the print head of FIG. 4, one actuator is allocated to the upper half nozzles of each color, and another actuator is allocated to the lower half nozzles. In general, the respective actuators have different ink ejection characteristics. Setting the nozzle groups by the actuators enables the dot recording position to be adjusted with a high accuracy.

In still another example, each nozzle group may be set to include nozzles for ejecting inks of substantially identical ejection-related properties. Some printing apparatus use both dye ink and pigment ink. The dye ink and the pigment ink have different physical properties, such as the viscosity, specific gravity, and surface tension of ink, and thereby different ink ejection characteristics. In the printing apparatus having such inks, setting nozzles corresponding to the dye ink to one nozzle group and nozzles corresponding to the pigment ink to another nozzle group enables the dot recording position to be adjusted with a high accuracy.

In the case where the print head has a plurality of inks having an identical hue but different densities as in the example of FIG. 19, each nozzle may include nozzles for ejecting inks of an equivalent density. In the example of FIG. 19, the nozzles corresponding to the cyan and magenta inks are included in one nozzle, and the nozzles corresponding to the light cyan and light magenta inks are included in another nozzle. The visual conspicuousness of dots is generally varied with a variation in density of ink. Setting the nozzle groups in this manner enables the dot recording position to be adjusted according to the visual conspicuousness of dots. In this case, the degree of adjustment of the dot recording position may be changed according to the density of ink. For example, with regard to the nozzle group corresponding to the inks of the higher density, the adjustment of the dot recording position is performed between the forward pass and the backward pass and among the different colors. With regard to the nozzle group corresponding to the inks of the lower density, on the other hand, the dot recording position is adjusted only in either one of the forward pass and the backward pass relative to the dot recording position for the ink of the higher density. This arrangement reduces the labor required for the adjustment of the dot recording position, while still improving the picture quality of the resulting printed image.

In addition, this invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

The present invention includes a computer program product which is a storage medium including instructions which can be used to program a computer to perform a process of the invention. The storage medium can include, but is not limited to, an type of disk including floppy disks, optical disks, CD-ROMs, and magneto-optical disks, ROMs, RAMs, EPROMs, EEPROMs, magnetic or optical cards, or any type of pure software inventions (e.g., word processing, accounting, Internet related, etc.) media suitable for storing electronic instructions.

The embodiment discussed above refers to the case of bidirectional recording. The technique of the present invention is, however, applicable to adjust the dot recording position between different nozzle groups in a printing apparatus that creates dots only in the forward pass or in the backward pass. The present invention is not restricted to the above embodiment or its modifications, but there may be many other modifications, changes, and alterations without departing from the scope or spirit of the main characteristics of the present invention.

What is claimed is:

1. A printing apparatus, comprising:

a print head having a plurality of nozzle groups, each nozzle group including a plurality of nozzles configured to eject ink to create dots on a surface of a printing medium at a predetermined dot creating timing during a forward and backward main scan and having a predetermined common condition relating to ink ejection;

a timing specification unit configured to input an instruction to change the dot creation timing during the main scan with regard to each of at least two nozzle groups selected among said plurality of nozzle groups;

an adjustment unit configured to adjust the dot creation timing with regard to said each nozzle group based on the instruction input from the timing specification unit; and a drive control unit configured to drive said each nozzle group at the adjusted dot creation timing during the main scan so as to create the dots, wherein said adjustment unit defines a specific nozzle group having an earliest dot creation timing among said at least two nozzle groups as a standard and adjusts the dot creation timing of another nozzle group relative to the standard.

2. A printing apparatus according to claim 1, wherein said print head is configured to eject inks of multiple colors, and each of said plurality of nozzle groups comprises a plurality of nozzles configured to eject an identical color ink.

3. A printing apparatus according to claim 2, wherein said at least two nozzle groups correspond to specific colors that are selected out of the multiple colors and other than a predetermined color having a little effect on a picture quality.

4. A printing apparatus according to claim 1, wherein each of said plurality of nozzle groups comprises a plurality of nozzles having an identical position in a main scanning direction.

5. A printing apparatus according to claim 1, wherein said print head has a number of driving units, each driving unit having a plurality of driving elements configured to drive the nozzles so as to enable one driving element to be mapped to one nozzle, and each of said plurality of nozzle groups comprises a plurality of nozzles that are driven by an identical driving unit.

6. A printing apparatus according to claim 1, wherein said print head ejects a plurality of different inks having different properties relating to ink ejection, and each of said plurality of nozzle groups comprises a plurality of nozzles configured to eject ink having a substantially identical property.

7. A printing apparatus according to claim 1, wherein said print head ejects a plurality of different inks having different densities, and each of said plurality of nozzle groups comprises a plurality of nozzles configured to eject ink of an equivalent density.

8. A printing apparatus according to claim 1, wherein said adjustment unit has a delay circuit corresponding to each of said plurality of nozzle groups, said delay circuit configured to adjust an output timing of a driving signal of said print head in response to the instruction input from the timing specification unit.

9. A printing apparatus according to claim 1, wherein said drive control unit drives said print head in both forward and backward passes of the main scan.

10. A printing apparatus according to claim 9, further comprising a test pattern printing unit configured to print a predetermined test pattern with each of said at least two nozzle groups, the predetermined test pattern being set to allow detection of a relative misalignment of dots created in the forward pass of the main scan with dots created in the backward pass of the main scan.

11. A printing apparatus according to claim 10, wherein said test pattern printing unit comprises:

a specific group test pattern printing unit configured to print a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and another group test pattern printing unit configured to print a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

12. A printing apparatus according to claim 10, wherein said test pattern printing unit prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

13. A printing apparatus according to claim 10, wherein said test pattern printing unit prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

14. A printing apparatus according to claim 10, wherein said timing specification unit specifies the dot creation timing based on a relation to the printed test pattern.

15. A recording medium in which a specific program is recorded in a computer readable manner, said specific program functioning to adjust a dot creation timing with regard to each of a plurality of nozzle groups in a printing apparatus that performs a main scan and causes a print head having nozzles for ejecting ink to create dots on a surface of a printing medium at a predetermined dot creation timing in the course of the main scan, in which each of said nozzle groups comprises a plurality of nozzles having a predetermined common condition relating to ink ejection and the main scan moves said print head forward and backward relative to said printing medium, said specific program causing a computer to attain functions of:

printing a predetermined test pattern with each of at least two nozzle groups selected among said plurality of nozzle groups, the predetermined test pattern being set to allow detection of a relative misalignment of dots created in the forward pass of the main scan with dots created in the backward pass of the main scan;

inputting a specified dot creation timing with regard to each of said nozzle groups based on a relation to the printed test pattern; and changing a parameter, which specifies the dot creation timing, with regard to said each nozzle group based on the specified dot creation timing, wherein said changing function defines a specific nozzle group having an earliest dot creation timing among said at least two nozzle groups as a standard and changes the dot creation timing of another nozzle group relative to the standard.

16. A recording medium in which a specific program for driving a printing apparatus is recorded in a computer readable manner, said printing apparatus including a print head having a plurality of nozzle groups, each nozzle group including a plurality of nozzles configured to eject ink to create dots on a surface of a printing medium at a predetermined dot creating timing during a forward and backward main scan and having a predetermined common condition relating to ink ejection; a timing specification unit configured to input an instruction to change the dot creation timing during the main scan with regard to each of at least two nozzle groups selected among said plurality of nozzle groups; an adjustment unit configured to adjust the dot creation timing with regard to said each nozzle group based on the instruction input from the timing specification unit; and a drive control unit configured to drive said each nozzle group at the adjusted dot creation timing during the main scan so as to create the dots, and said specific program causing a computer controlling the printing apparatus to attain functions of:

adjusting the dot creation timing with regard to each color in response to the instruction input from the timing specification unit, wherein said adjustment function defines a specific nozzle group having an earliest dot creation timing among said at least two nozzle groups as a standard and adjusts the dot creation timing of another nozzle group relative to the standard.

17. A printing system comprising:

a print head having a plurality of nozzle groups, each nozzle group comprising a plurality of nozzles for ejecting ink to create dots on a surface of a printing medium at a predetermined dot creation timing during a forward and backward main scan and having a predetermined common condition relating to ink ejection;

means for inputting an instruction to change the dot creation timing during the main scan with regard to each of at least two nozzle groups selected among said plurality of nozzle groups;

means for adjusting the dot creation timing with regard to said each nozzle group based on the instruction input from the inputting means; and means for driving said each nozzle group at the adjusted dot creation timing during the main scan so as to create dots, wherein said adjustment means defines a specific nozzle group having an earliest dot creation timing among said at least two nozzle groups as a standard and adjusts the dot creation timing of another nozzle group relative to the standard.

18. A printing system according to claim 17, wherein said print head ejects inks of multiple colors, and each of said plurality of nozzle groups comprises a plurality of nozzles for ejecting an identical color ink.

19. A printing system according to claim 18, wherein said at least two nozzle groups correspond to specific colors that are selected out of the multiple colors and other than a predetermined color having a little effect on picture quality.

20. A printing system according to claim 17, wherein each of said plurality of nozzle groups comprises a plurality of nozzles having an identical position in a main scanning direction.

21. A printing system according to claim 17, wherein said print head has a number of driving units, each driving unit having a plurality of driving elements for driving the nozzles so as to enable one driving element to be mapped to one nozzle, and each of said plurality of nozzle groups comprises a plurality of nozzles that are driven by an identical driving unit.

22. A printing system according to claim 17, wherein said print head ejects a plurality of different inks having different properties relating to ink ejection, and each of said plurality of nozzle groups comprises a plurality of nozzles for ejecting ink having a substantially identical property.

23. A printing system according to claim 17, wherein said print head ejects a plurality of different inks having different densities, and each of said plurality of nozzle groups comprises a plurality of nozzles for ejecting ink of an equivalent density.

24. A printing system according to claim 17, wherein said adjustment means has a delay circuit corresponding to each of said plurality of nozzle groups for adjusting an output timing of a driving signal of said print head in response to the instruction to change.

25. A printing system according to claim 17, wherein said driving means drives said print head in both forward and backward passes of the main scan.

26. A printing system according to claim 25, further comprising:

means for printing a predetermined test pattern with each of said at least two nozzle groups, the predetermined test pattern being set to allow detection of a relative misalignment of dots created in the forward pass of the main scan with dots created in the backward pass of the main scan.

27. A printing system according to claim 26, wherein said means for printing a predetermined pattern comprises:

first means for printing a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and second means for printing a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

28. A printing system according to claim 26, wherein said first means for printing prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

29. A printing system according to claim 26, wherein said first means for printing prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

30. A printing system according to claim 26, wherein said input means specifies the dot creation timing based on a relation to the printed test pattern.

31. A method of printing with a printer apparatus including a print head having a plurality of nozzle groups, each nozzle group including a plurality of nozzles for ejecting ink to create dots on a surface of a printing medium at a predetermined dot creation timing during a forward and backward main scan and having a predetermined common condition relating to ink rejection, said method comprising the steps of:

inputting an instruction to change the dot creation timing during the main scan with regard to each of at least two nozzle groups selected among said plurality of nozzle groups;

adjusting the dot creation timing with regard to said each nozzle group based on the input from the inputting step; and driving said each nozzle group at the adjusted dot creation timing during the main scan so as to create the dots, wherein said adjustment step defines a specific nozzle group having an earliest dot creation timing among said at least two nozzle groups as a standard and adjusts the dot creation timing of another nozzle group relative to the standard.

32. A printing method according to claim 31, wherein said print head ejects inks of multiple colors, and each of said plurality of nozzle groups comprises a plurality of nozzles for ejecting an identical color ink.

33. A printing method according to claim 31, wherein said at least two nozzle groups correspond to specific colors that are selected out of the multiple colors and other than a predetermined color having a little effect on picture quality.

34. A printing method according to claim 31, wherein each of said plurality of nozzle groups comprises a plurality of nozzles having an identical position in a main scanning direction.

35. A printing method according to claim 31, wherein said print head has a number of driving units, each driving unit having a plurality of driving elements for driving the nozzles so as to enable one driving element to be mapped to one nozzle, and each of said plurality of nozzle groups comprises a plurality of nozzles that are driven by an identical driving unit.

36. A printing method according to claim 31, wherein said print head ejects a plurality of different inks having different properties relating to ink ejection, and each of said plurality of nozzle groups comprises a plurality of nozzles for ejecting ink having a substantially identical property.

37. A printing method according to claim 31, wherein said print head ejects a plurality of different inks having different densities, and each of said plurality of nozzle groups comprises a plurality of nozzles for ejecting ink of an equivalent density.

38. A printing method according to claim 31, wherein said adjustment step adjusts an output timing of a driving signal of said print head in response to the instruction to change via a delay circuit corresponding to each of said plurality of nozzle groups.

39. A printing method according to claim 31, wherein said driving step drives said print head in both forward and backward passes of the main scan.

40. A printing method according to claim 39, further comprising the step of:

printing a predetermined test pattern with each of said at least two nozzle groups, the predetermined test pattern being set to allow detection of a relative misalignment of dots created in the forward pass of the main scan with dots created in the backward pass of the main scan.

41. A printing method according to claim 40, wherein said printing step comprises the steps of:

printing a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and printing a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

42. A printing method according to claim 40, wherein said step of printing the first test pattern prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

43. A printing method according to claim 40, wherein said step of printing the first test pattern prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

44. A printing method according to claim 40, wherein said input step specifies the dot creation timing based on a relation to the printed test pattern.

45. A printing apparatus, comprising:

a print head having a plurality of nozzle groups, each nozzle group including a plurality of nozzles configured to eject ink to create dots on a surface of a printing medium at a predetermined dot creating timing during a forward and backward main scan and having a predetermined common condition relating to ink ejection;

a timing specification unit configured to input an instruction to change the dot creation timing during the main scan with regard to each of at least two nozzle groups selected among said plurality of nozzle groups;

an adjustment unit configured to adjust the dot creation timing with regard to said each nozzle group based on the input;

a drive control unit configured to drive said each nozzle group at the adjusted dot creation timing during the main scan so as to create the dots; and a test pattern printing unit configured to print a predetermined test pattern with each of said at least two nozzle groups, the predetermined test pattern being set to allow detection of a relative misalignment of dots created in the forward pass of the main scan with dots created in the backward pass of the main scan, wherein said drive control unit drives said print head in both forward and backward passes of the main scan, and wherein said test pattern printing unit comprises:

a specific group test pattern printing unit configured to print a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and another group test pattern printing unit configured to print a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

46. A printing apparatus according to claim 45, wherein said test pattern printing unit prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

47. A printing apparatus according to claim 45, wherein said test pattern printing unit prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

48. A printing apparatus according to claim 45, wherein said timing specification unit specifies the dot creation timing based on a relation to the printed test pattern.

49. A printing system comprising:

a print head having a plurality of nozzle groups, each nozzle group comprising a plurality of nozzles for ejecting ink to create dots on a surface of a printing medium at a predetermined dot creation timing during a forward and backward main scan and having a predetermined common condition relating to ink ejection;

means for inputting an instruction to change the dot creation timing during the main scan with regard to each of at least two nozzle groups selected among said plurality of nozzle groups;

means for adjusting the dot creation timing with regard to said each nozzle group based on the instruction input from the inputting means;

means for driving said each nozzle group at the adjusted dot creation timing during the main scan so as to create dots; and means for printing a predetermined test pattern with each of said at least two nozzle groups, the predetermined test pattern being set to allow detection of a relative misalignment of dots created in the forward pass of the main scan with dots created in the backward pass of the main scan, wherein said driving means drives said print head in both forward and backward passes of the main scan, and wherein said means for printing a predetermined test pattern comprises:

first means for printing a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and second means for printing a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

50. A printing system according to claim 49, wherein said first means for printing prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

51. A printing system according to claim 49, wherein said first means for printing prints a specific test pattern with a certain nozzle group corresponding to a specific color of low visual conspicuousness, among said at least two nozzle groups that are the objects of the instruction to change, the specific test pattern including both dots created by said certain nozzle group and dots created by another nozzle group, which has an adjusted dot creation timing, to enhance visual conspicuousness of the relative misalignment.

52. A printing system according to claim 49, wherein said input means specifies the dot creation timing based on a relation to the printed test pattern.

53. A method of printing with a printer apparatus including a print head having a plurality of nozzle groups, each nozzle group including a plurality of nozzles for ejecting ink to create dots on a surface of a printing medium at a predetermined dot creation timing during a forward and backward main scan and having a predetermined common condition relating to ink ejection, said method comprising the steps of:

inputting an instruction to change the dot creation timing during the main scan with regard to each of at least two nozzle groups selected among said plurality of nozzle groups;

adjusting the dot creation timing with regard to said each nozzle group based on the input from the inputting step;

driving said each nozzle group at the adjusted dot creation timing during the main scan so as to create the dots; and printing a predetermined test pattern with each of said at least two nozzle groups, the predetermined test pattern being set to allow detection of a relative misalignment of dots created in the forward pass of the main scan with dots created in the backward pass of the main scan, wherein said driving step drives said print head in both forward and backward passes of the main scan, and wherein said printing step comprises the steps of:

printing a first test pattern with one specific nozzle group, which is selected among said at least two nozzle groups, the first test pattern including dots created in the forward pass of the main scan and dots created in the backward pass of the main scan at a preset positional relationship, which allows detection of a relative misalignment of dot recording positions in the forward pass and in the backward pass; and printing a second test pattern, the second test pattern including dots created by another nozzle group other than the specific nozzle group and dots created by said specific nozzle group, to allow detection of a relative misalignment of dot recording positions of said another nozzle group and said specific nozzle group in at least one of the forward pass and the backward pass of the main scan.

54. A printing method according to claim 53, wherein said step of printing the first test pattern prints a certain test pattern with each of said at least two nozzle groups, the certain test pattern including both dots created in the forward pass of the main scan and dots created in the backward pass of the main scan at a predetermined positional relationship, which allows detection of a relative misalignment of dot recording positions in the forward pass and in the backward pass.

55. A printing method according to claim 53, wherein said step of printing the first test pattern prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

56. A printing method according to claim 53, wherein said input step specifies the dot creation timing based on a relation to the printed test pattern.

57. A printing apparatus that performs a main scan and causes a print head having nozzles for ejecting ink to create dots on a surface of a printing medium at a predetermined dot creation timing in the course of the main scan, the main scan moving said print head forward and backward relative to said printing medium, wherein said print head has a plurality of nozzle groups, each nozzle group comprising a plurality of nozzles having a predetermined common condition relating to ink ejection, said printing apparatus comprising:

a timing specification unit that inputs an instruction to change the dot creation timing in the course of the main scan with regard to each of at least two nozzle groups selected among said plurality of nozzles groups;

an adjustment unit that adjusts the dot creation timing with regard to said each nozzle group based on the input; and a drive control unit that drives said each nozzle group at the dot creation timing corresponding to each of the forward and backward passes of the main scan so as to create dots, wherein said adjustment unit defines a specific nozzle group having an earliest dot creation timing among said at least two nozzle groups as a standard and adjusts the dot creation timing of another nozzle group relative to the standard.

58. A printing apparatus according to claim 57, wherein said test pattern printing unit prints a specific test pattern with a certain nozzle group corresponding to a specific color having little effect on a picture quality among said at least two nozzle groups, the specific test pattern including both dots created by said certain nozzle group and dots created by another nozzle group, which has an adjusted dot creation timing, to enhance visual conspicuousness of the relative misalignment.

* * * * *